US011484758B2

(12) United States Patent
Lalaoua

(10) Patent No.: US 11,484,758 B2
(45) Date of Patent: Nov. 1, 2022

(54) ANNULAR MULTIMEDIA STADIUM GOALPOST AND MULTIPURPOSE TARGET DISPLAY SYSTEM

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 505 days.

(21) Appl. No.: 16/588,337

(22) Filed: Sep. 30, 2019

(65) Prior Publication Data

US 2020/0023254 A1 Jan. 23, 2020

Related U.S. Application Data

(63) Continuation-in-part of application No. 16/262,660, filed on Jan. 30, 2019, now Pat. No. 10,926,144, and
(Continued)

(51) Int. Cl.
*A63B 63/00* (2006.01)
*A63B 43/00* (2006.01)
(Continued)

(52) U.S. Cl.
CPC ..... *A63B 63/00* (2013.01); *A63B 24/0021* (2013.01); *A63B 43/004* (2013.01); *A63B 71/0669* (2013.01); *G09F 19/18* (2013.01); *G09F 23/0066* (2013.01); *A63B 63/004* (2013.01); *A63B 63/008* (2013.01); *A63B 63/083* (2013.01); *A63B 2024/0028* (2013.01); *A63B 2071/0625* (2013.01);
(Continued)

(58) Field of Classification Search
CPC ... A63B 63/00; A63B 24/0021; A63B 43/004; A63B 71/0669; G09F 19/18; G09F 23/0066
USPC ..... 473/476, 78
See application file for complete search history.

(56) References Cited

U.S. PATENT DOCUMENTS 1,923,152 A * 8/1933 Kohn ..... A63B 63/00 473/190
4,492,049 A * 1/1985 Gaylor ..... G09F 23/00 40/607.01
(Continued)

FOREIGN PATENT DOCUMENTS

WO WO2018127855 A1 7/2018

*Primary Examiner* — John E Simms, Jr.
*Assistant Examiner* — Rayshun K Peng

(57) ABSTRACT

An annular multimedia stadium goalpost and multipurpose target display system. The system includes a rear support-and-multimedia assembly for supporting the net and producing audible and visual effects. The system also includes a at least one annular frame and a primary projector. The rear support-and-multimedia assembly includes a support assembly and a multimedia bar system. The support assembly maintains the annular frame and the multimedia bar system in an orientation that facilitates playing sports and projecting information. The multimedia bar system includes a plurality of lights, a plurality of first speakers, a plurality of sponsor display panels, a retractably screen assembly, and a retractably underground projector in order to audible and visually convey content regarding the sports game and advertisements to the audience. The system also includes an annular display, and a multitude of rangefinder laser-detector video cameras to track, record, and present gameplay live.

29 Claims, 22 Drawing Sheets

Related U.S. Application Data a continuation-in-part of application No. 15/861,327, filed on Jan. 3, 2018, now Pat. No. 10,857,437, said application No. 16/262,660 is a continuation-in-part of application No. 15/861,327.

(60) Provisional application No. 62/710,826, filed on Mar. 1, 2018, provisional application No. 62/498,586, filed on Jan. 3, 2017.

(51) Int. Cl.

| | |
|---|---|
| ***G09F 23/00*** | (2006.01) |
| ***G09F 19/18*** | (2006.01) |
| ***A63B 24/00*** | (2006.01) |
| ***A63B 71/06*** | (2006.01) |
| ***A63B 63/08*** | (2006.01) |

(52) U.S. Cl.

CPC ..... *A63B 2209/00* (2013.01); *A63B 2220/20* (2013.01); *A63B 2220/803* (2013.01); *A63B 2220/806* (2013.01); *A63B 2220/833* (2013.01); *A63B 2225/09* (2013.01); *A63B 2225/20* (2013.01); *A63B 2225/50* (2013.01); *A63B 2225/74* (2020.08)

(56) References Cited

U.S. PATENT DOCUMENTS

| | | | | |
|---|---|---|---|---|
| 5,615,880 | A * | 4/1997 | Booth | A63B 24/0021 473/570 |
| 7,115,053 | B2 * | 10/2006 | Meichner | A63B 63/00 473/477 |
| 9,233,294 | B1 * | 1/2016 | Coyle | A63B 69/34 |
| 9,943,737 | B1 * | 4/2018 | Burdan | A63H 33/18 |
| 2014/0100062 | A1 * | 4/2014 | Terrell | A63B 63/004 473/476 |
| 2016/0096096 | A1 * | 4/2016 | Bowman | A63B 63/06 473/478 |
| 2020/0376356 | A1 * | 12/2020 | Cardoso | A63B 63/00 |

* cited by examiner

ANNULAR MULTIMEDIA STADIUM GOALPOST AND MULTIPURPOSE TARGET DISPLAY SYSTEM

FIELD OF THE INVENTION

The present invention relates generally to sport field equipment and accessories. More specifically, the present invention is a ring-shaped goal and stadium ring-shaped goal net display with a screen projector device, a collision prevention system integrated into the support structure, a mapping projection device, and an electronic scoring and advertising display. The present invention includes a hologram projector, a ball and player sensing system, and a multimedia display system. The present invention provides an alternative and novel means for viewing and enjoying a new scoring entertainment solution and advertising projection in professional sporting events, specifically designed for sports played in a stadium. Some of the features and technologies of the present invention may be implemented in a variety of professional sports including, but not limited to, soccer, handball, football, American football, rugby, lacrosse, and polo to name a few non-limiting examples

BACKGROUND OF THE INVENTION

The present invention offers new solutions and important improvements that includes a new safety system and a new advertising display designed with today's technology in order to increase the quality of the game and the health of the players. Specifically, the present invention provides a novel means of integrating advertisement, logos, three-dimension projector devices, lights and siren systems, and screen projectors in and around the goal frame that comply with official rules of the sport. These features allow the audience and the players to experience the sport from a novel perspective. For example, the present invention includes a plurality of lights and laser beams to visually indicate the current score of the game. Additionally, siren horns are also used to announce the official scoring goal. Furthermore, the present invention includes a variety of projectors and screens which visually display information and or advertisement to the audience and or players.

The present invention also provides the referees and the administrators of the game with useful information when a ball is in the vicinity of the goal frame. In particular, the present invention utilizes a multitude of sensing systems in order to track and determine if the ball truly passed through the center of the goal frame. One of the sensing systems includes a multitude of cameras integrated into specific areas of the goal frame, as well as cameras positioned directly behind the goal frame. Another sensing system includes a rangefinder laser video camera and a sensor integrated into the ball which allows the present invention to track the real-time location of the ball. Thus, the present invention provides the referee and the administrators with empirical data that a goal was scored.

DETAIL DESCRIPTIONS OF THE INVENTION

Figure 1:
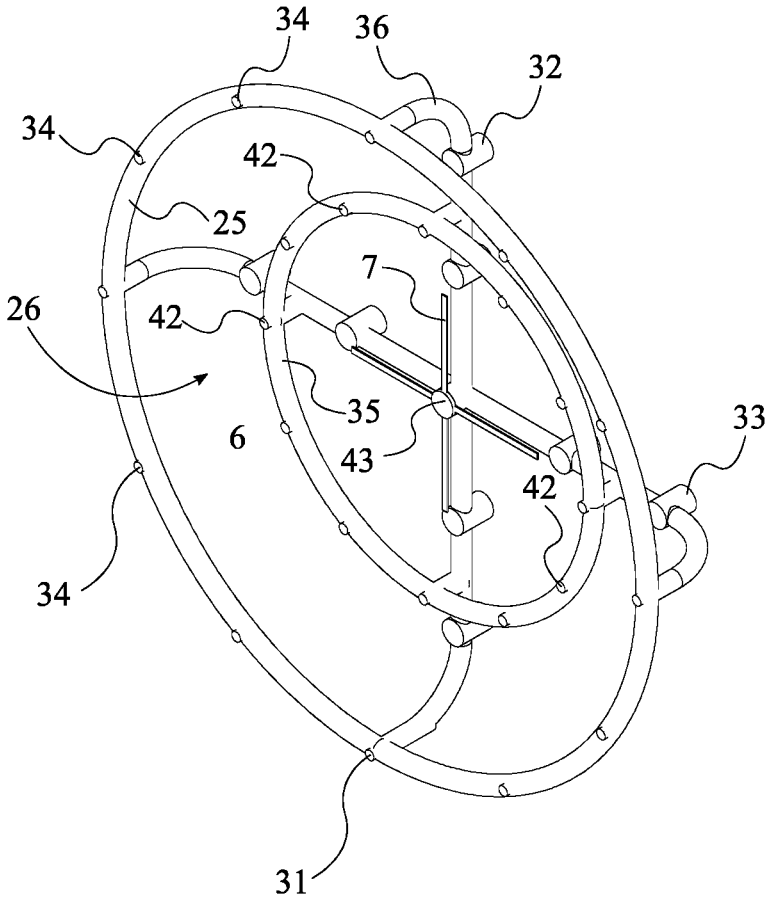
FIG. 1 is a perspective view of an embodiment of the present used without a support structure.

All illustrations of the drawings are for the purpose of describing selected versions of the present invention and are not intended to limit the scope of the present invention.

Referring to FIG. 1 through FIG. 22, the preferred embodiment of the present invention, the annular multimedia stadium goalpost and multipurpose target display system, is a device that functions as a goal for various sports games. The present invention uses a ring-shaped goal to provide enhanced scoring and entertainment functions. To accomplish this, the present invention comprises a support assembly 1, a multimedia bar system 6, a primary annular frame 25, and at least one primary projector 28. The support assembly 1 is a structure designed to maintain the annular frame in a desired position. The multimedia bar system 6 provides audio and visual content to the audience and the referees/administrative personnel relating to the score, gameplay, player status, and advertisement of the game. The primary annular frame 25 is mounted onto the support assembly 1. As a result, the support assembly 1 maintains the primary annular frame 25 in a position that facilitates playing a sports game. Preferably, the support assembly 1 is a rigid post that is erected at one end of a sports field.

The support assembly 1 holds the primary annular frame 25 in a position that enables an athlete to score a point by throwing or kicking a ball 52 through a central portion 26 of the primary annular frame 25. In an alternative embodiment, the support assembly 1 is a structure that enables the annular frame to be mounted onto a wall or any other type of physical structure. In a separate alternative embodiment, the support assembly 1 includes an interactive console that enables an individual to move the primary annular frame 25. Thus, enabling the individual to use the present invention while performing traditional and non-traditional sports. Specifically, the support assembly 1 is designed to reposition the primary annular 25 frame at any point. In some embodiments, the support assembly 1 is a motorized system that enables the primary annular frame 25 to be positioned at various heights above the ground. The multimedia bar system 6 is mounted onto the support assembly 1. Additionally, the multimedia bar system 6 is positioned offset from the primary annular frame 25, across the support assembly 1. As a result, the multimedia bar system 6 does not hinder the athlete's attempts to score. Further, the positioning of the multimedia bar system 6 facilitates displaying visual information to the athlete as well as a stadium audience. The primary projector 28 is preferably a three-dimensional (3D) hologram projector. However, various other types of projectors including, but not limited to, DLP projectors, long throw zoom projectors, laser projectors, and traditional projector are suitable as well. The primary projector 28 is mounted onto the primary annular frame 25. Additionally, the primary projector 28 is optically coupled to a central portion 26 of the primary annular frame 25. Accordingly, the primary projector 28 is maintained in a position that facilitates projecting a holographic image within the central portion 26 of the primary annular frame 25. Preferably, the primary projector 28 is designed to be pivotably and slidably mounted onto the primary annular frame 25. Thus mounted, the primary projector 28 can be used to project images into the stands, the sky, or the field as well. Additionally, if two copies of the present invention are being used as the goals for a sports game, then the primary projector 28 of a first copy can be used to project information onto a second copy that is positioned across the field of play.

Figure 22:
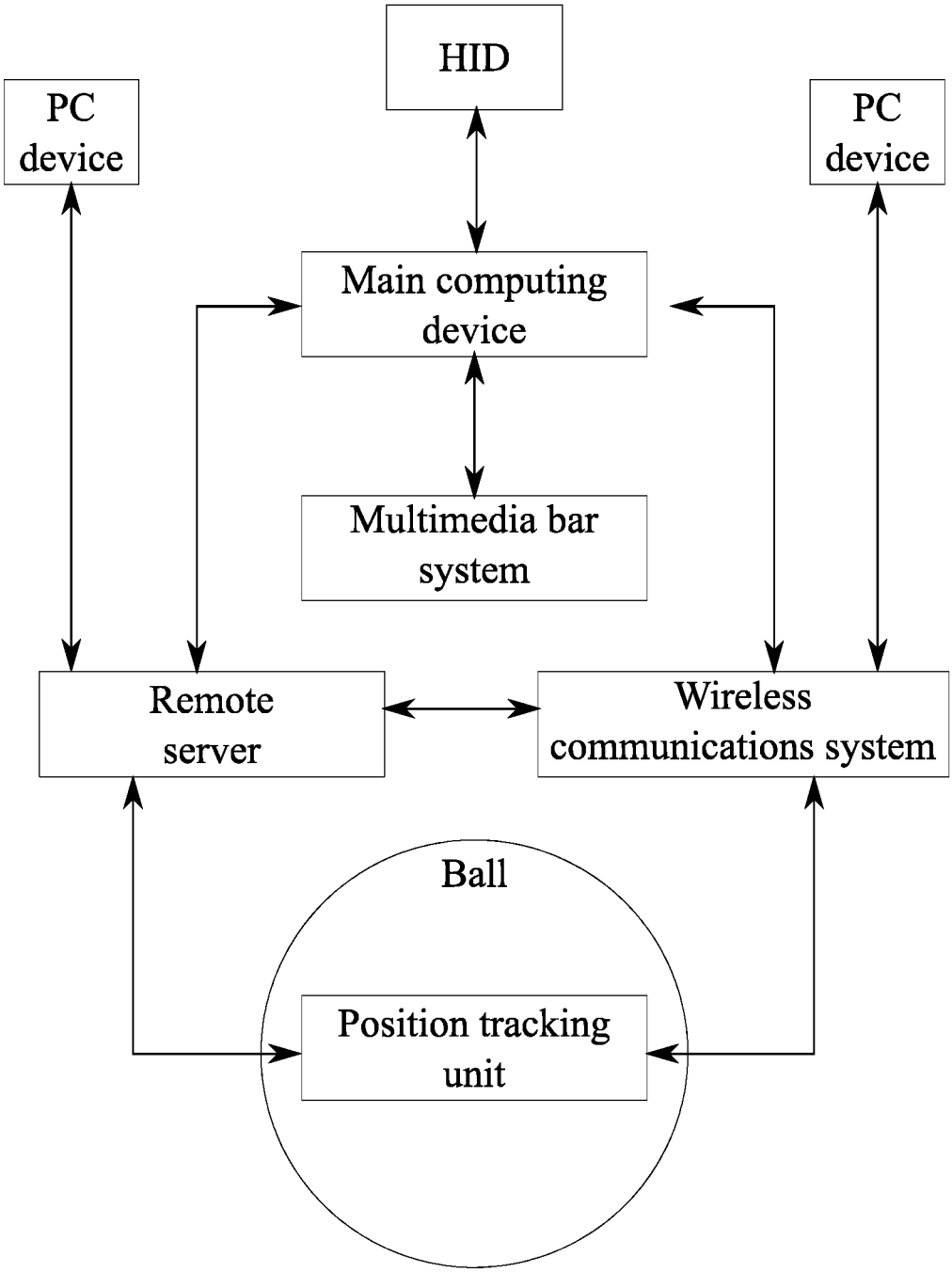
FIG. 22 is a block diagram illustrating electrical and data transmission between the components of the present invention.

Referring to FIG. 1 and FIG. 22, the present invention is designed to function as a goal that uses a collection of sensors to track the position of the ball 52 and to determine when the ball 52 has been passed through the central portion 26 of the primary annular frame 25. To accomplish this, the present invention further comprises at least one primary environmental sensor 29. The at least one primary environmental sensor 29 is integrated into the primary annular frame 25. As a result, the at least one primary environmental sensor 29 can monitor the environment around the present invention. Preferably, the at least one primary environmental sensor 29 is a plurality of environmental sensors that comprises a plurality of motion sensors 30 and a plurality of proximity sensors 31. These sensors enable the present invention to capture multiple types of data and to determine if the athlete has scored by passing the ball 52 through the central portion 26 of the primary annular frame 25. To facilitate this, the plurality of motion sensors 30 and the plurality of proximity sensors 31 are distributed around the primary annular frame 25. Additionally, the plurality of motion sensors 30 and the plurality of proximity sensors 31 are oriented toward the central portion 26 of the primary annular frame 25. As a result, the present invention is able to capture data from multiple angles and accurately determine when the ball 52 passes through the central portion 26 of the primary annular frame 25.

Figure 4:
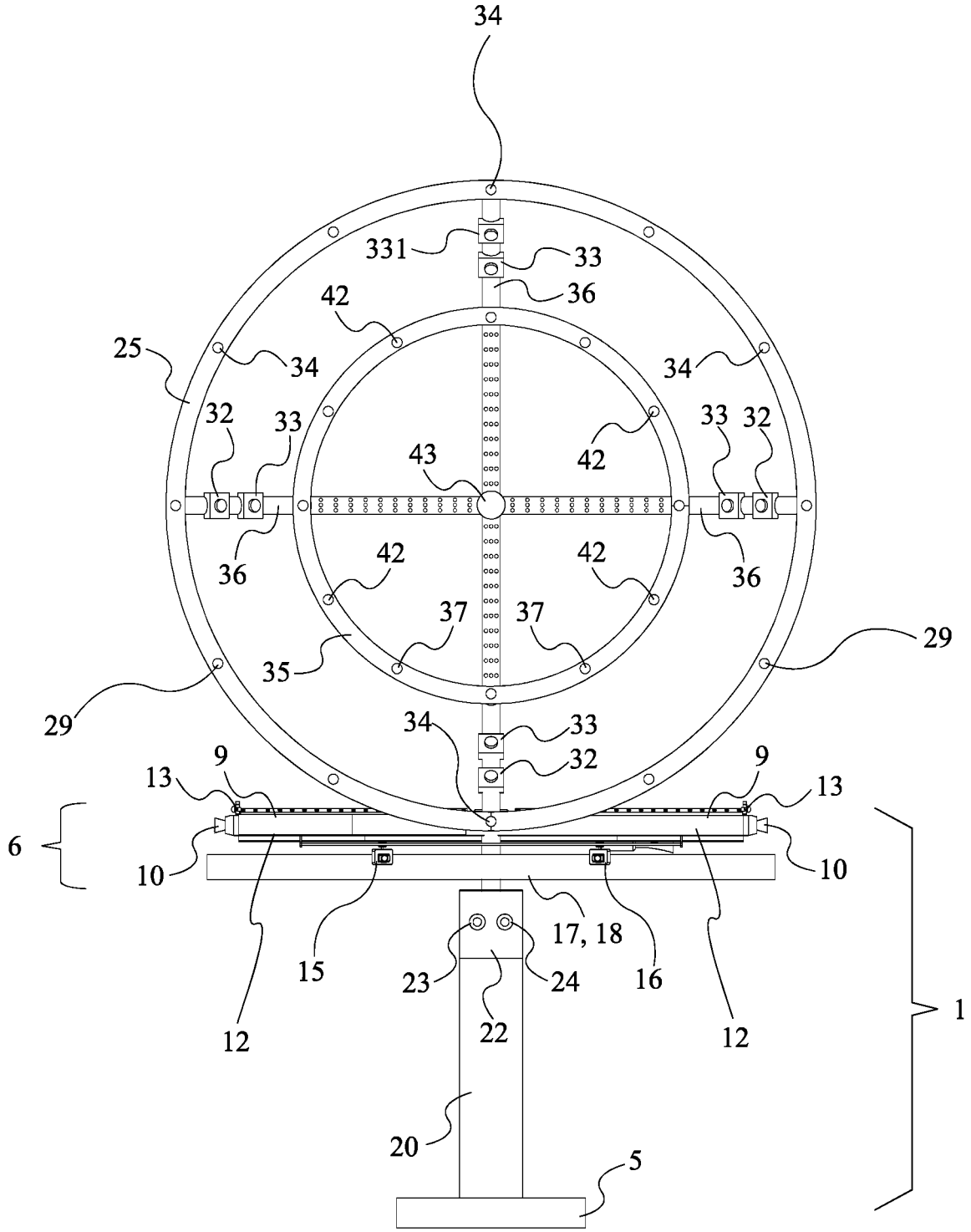
FIG. 4 is a front view of the present invention.

Referring to FIG. 1, FIG. 4, and FIG. 22, the present invention is designed to enhance the entertainment value and informational output generated by a goal. To facilitate this, the present invention further comprises a primary annular display 34. The primary annular display 34 is integrated into the primary annular frame 25, such that the primary annular display 34 is concentrically aligned to the primary annular frame 25. As a result, various sections of the primary annular display 34 can be lighted to visually output information and advertisements. For example, the primary annular display 34 can be used to display a countdown timer to indicate the end of a period. Alternatively, the primary annular display 34 can be directed to display information that includes, but is not limited to, the score, who is in possession of the ball 52, player statistics, advertisements, and weather conditions. The operations of the primary annular display 34 can be coordinated with the at least one primary environmental sensor 29 to automatically alert the field referee and athlete when the ball 52 passes through the central portion 26 of the primary annular frame 25. Preferably, the primary annular display 34 comprises a plurality of LEDs that is distributed across the exterior surface of the primary annular display 34.

Figure 2:
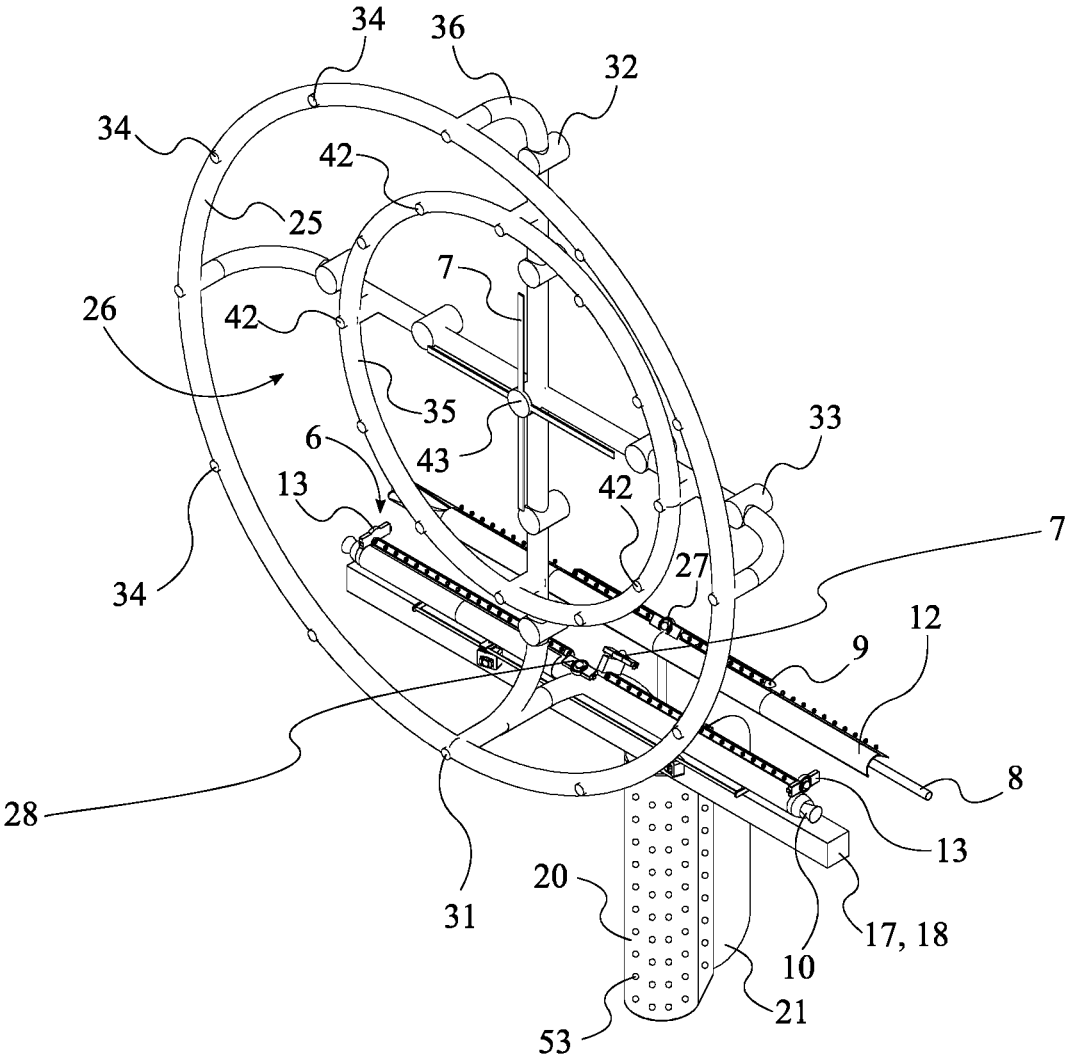
FIG. 2 is a perspective view of an embodiment of the present invention with a soft LED display superimposed onto the airbag padding system.
Figure 3:
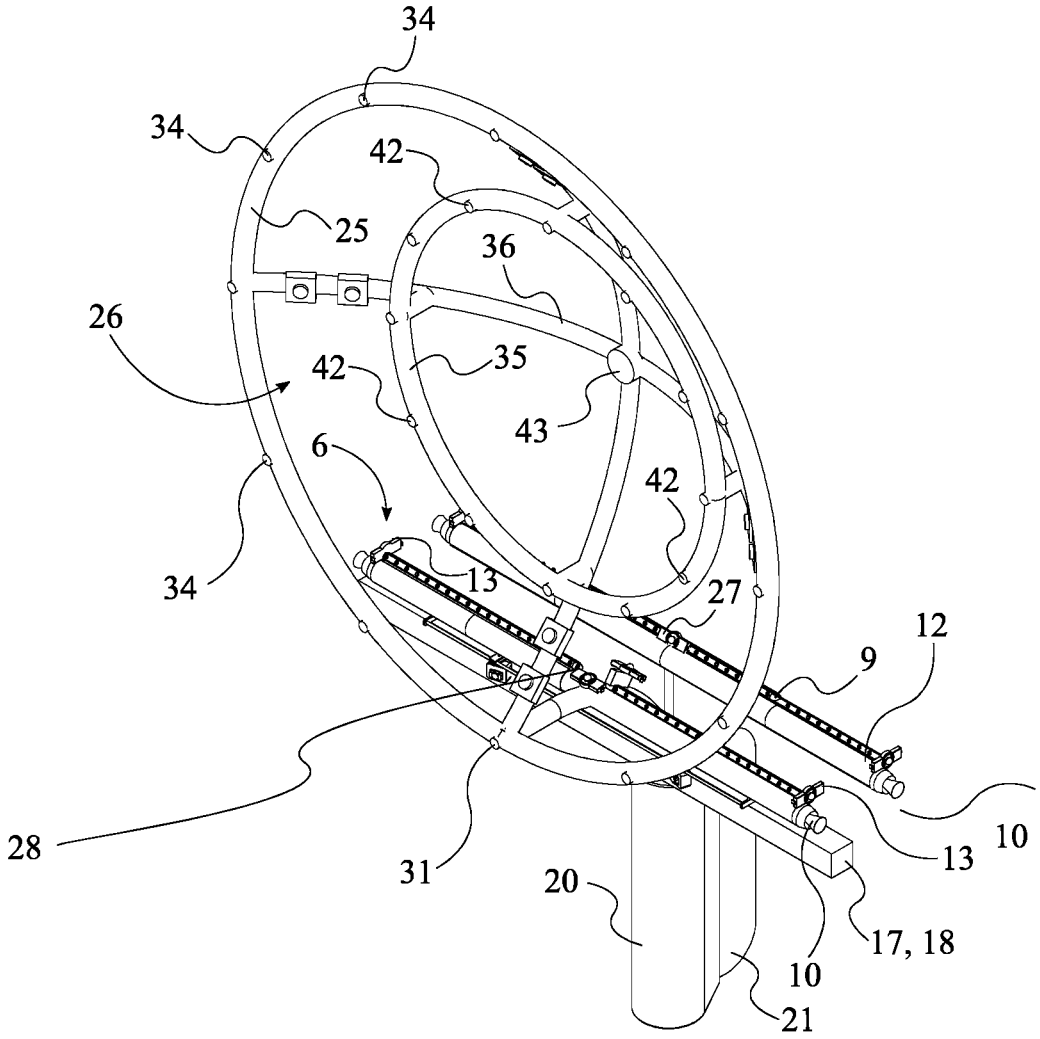
FIG. 3 is a perspective view of the present invention with the net removed.
Figure 7:
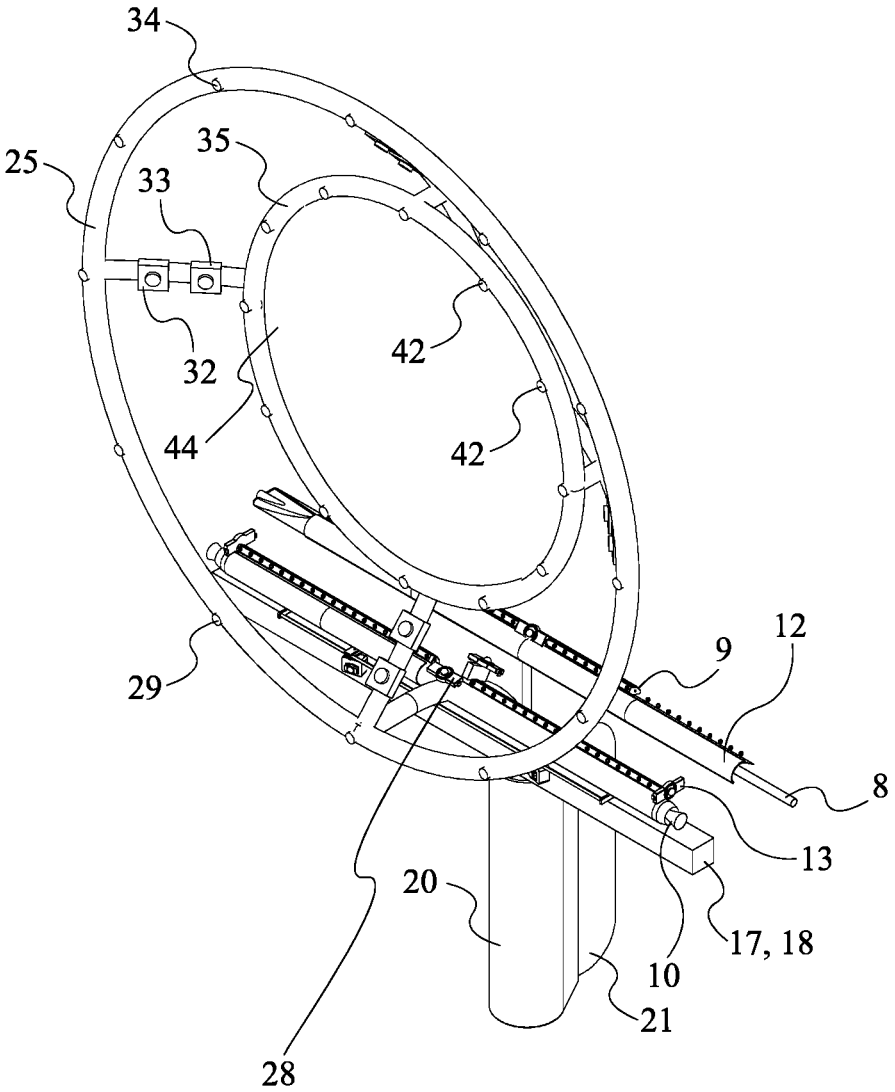
FIG. 7 is a perspective view of an embodiment of the present invention with a flat display being used as the net.

Referring to FIG. 2, FIG. 4, and FIG. 7, while the most basic version of the present invention features a single annular frame, various embodiments feature modifications that enhance the enjoyment gained from participating in the sports game. Accordingly, the present invention further comprises at least one secondary annular frame 35 and an intermediary support frame 36. The secondary annular frame 35 is a smaller goal frame that serves to enhance the difficulty of the sports game. The intermediary support frame 36 is connected in between the primary annular frame 25 and the secondary annular frame 35. Additionally, the secondary annular frame 35 is concentrically aligned to the primary annular frame 25. As a result, the intermediary support frame 36 maintains the secondary annular frame 35 in a position that enables the secondary annular frame 35 to function as a target goal through which the athlete must pass the ball 52. Preferably, the intermediary support frame 36 comprises at least three support arms that extend between the primary annular frame 25 and the secondary annular frame 35 to form a y-shaped support structure. Alternatively, the intermediary support frame 36 is formed into a cross-shaped frame. The intermediary support frame 36 is connected to a crowd-facing surface of the secondary annular frame 35 and a crowd-facing surface of the primary annular frame 25. Thus positioned, the intermediary support frame 36 cannot prevent the ball 52 from passing through the central portion 26 of the primary annular frame 25 or a central portion 26 of the secondary annular frame 35. That is, the intermediary support frame 36 is positioned such that the support arms do not interfere in the sports game.

Figure 14:
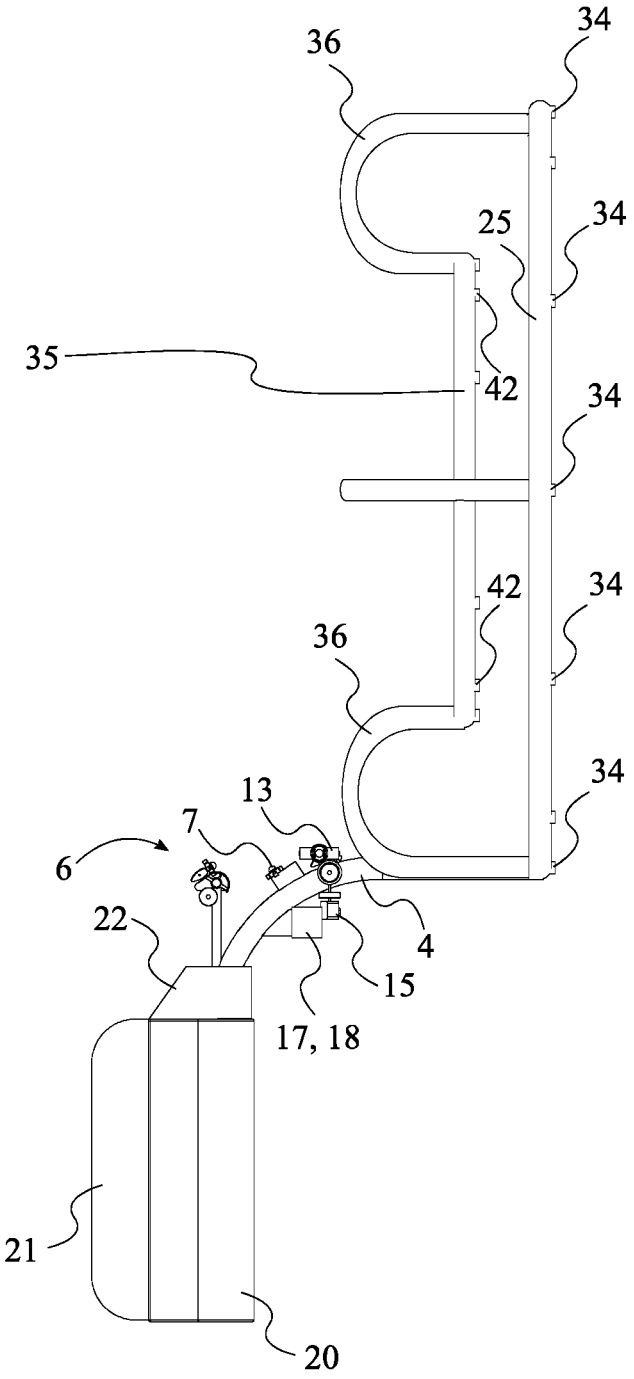
FIG. 14 is a left-side view of an embodiment of the present invention where the intermediary support frame is composed of a plurality of hook-shaped members.
Figure 15:
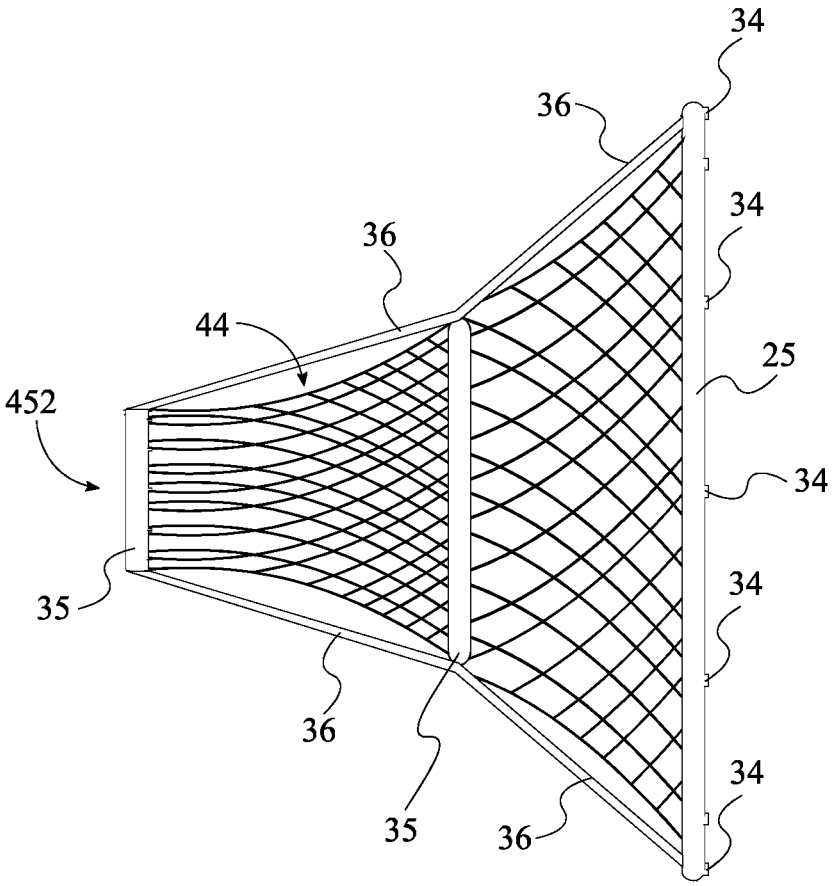
FIG. 15 is a left-side view of an embodiment of the present invention where the net is stretched between the primary annular frame and the secondary annular frame.
Figure 16:
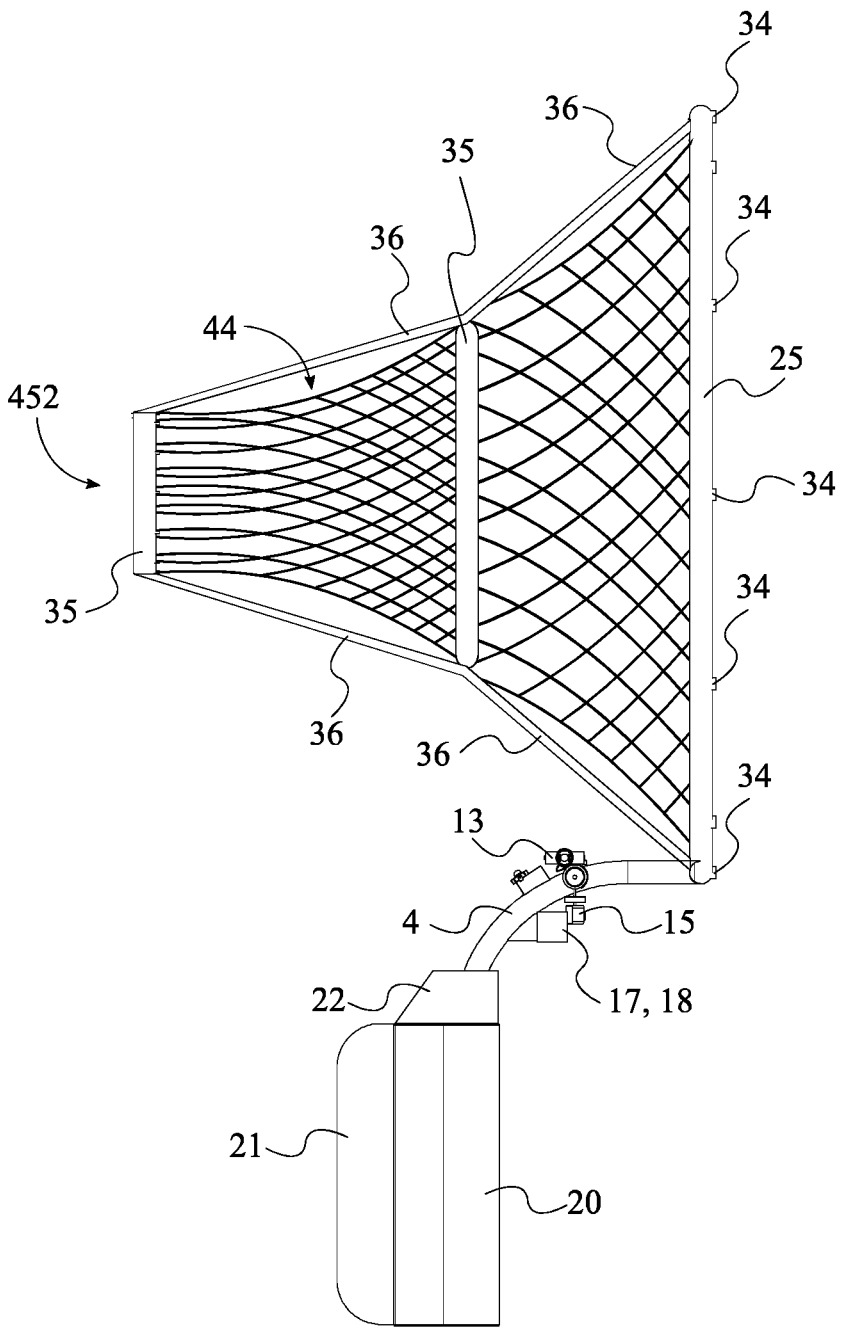
FIG. 16 is a left-side view of an embodiment of the present invention where the net is stretched between the primary annular frame and the secondary annular frame.
Figure 17:
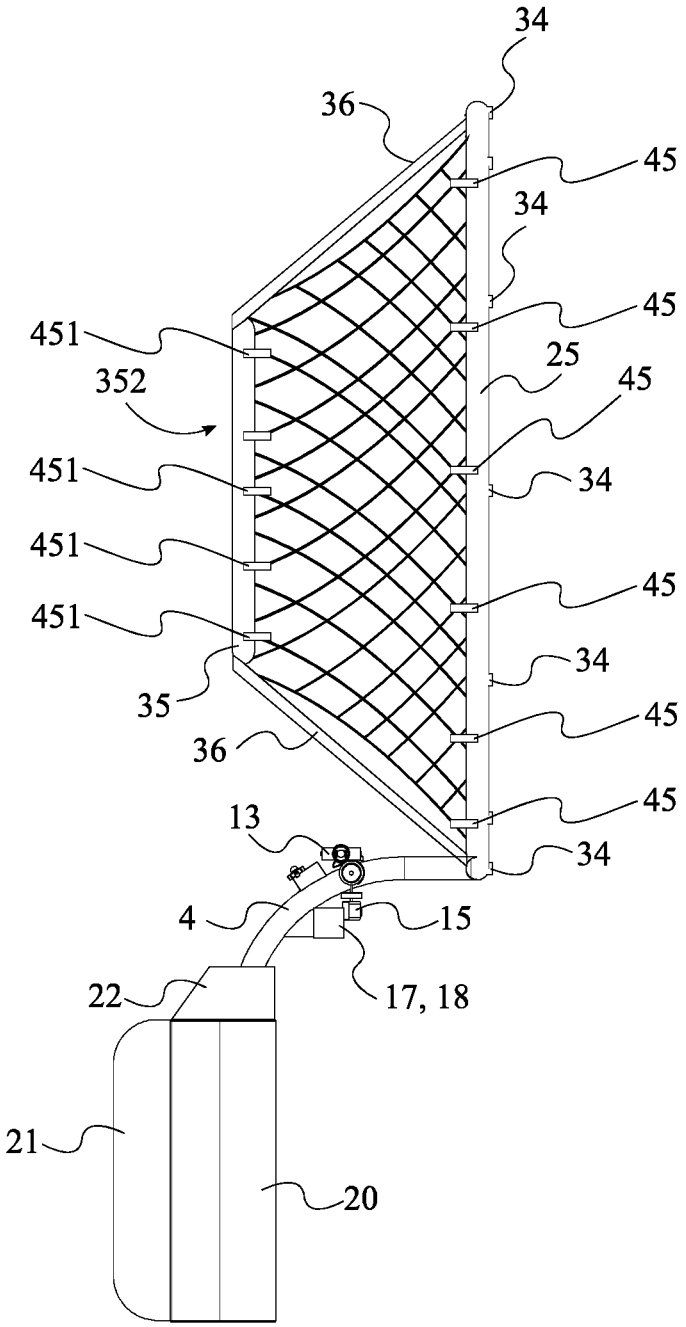
FIG. 17 is a left-side view of an embodiment of the present invention with the net attached by the plurality of sensor-integrated fasteners.
Figure 18:
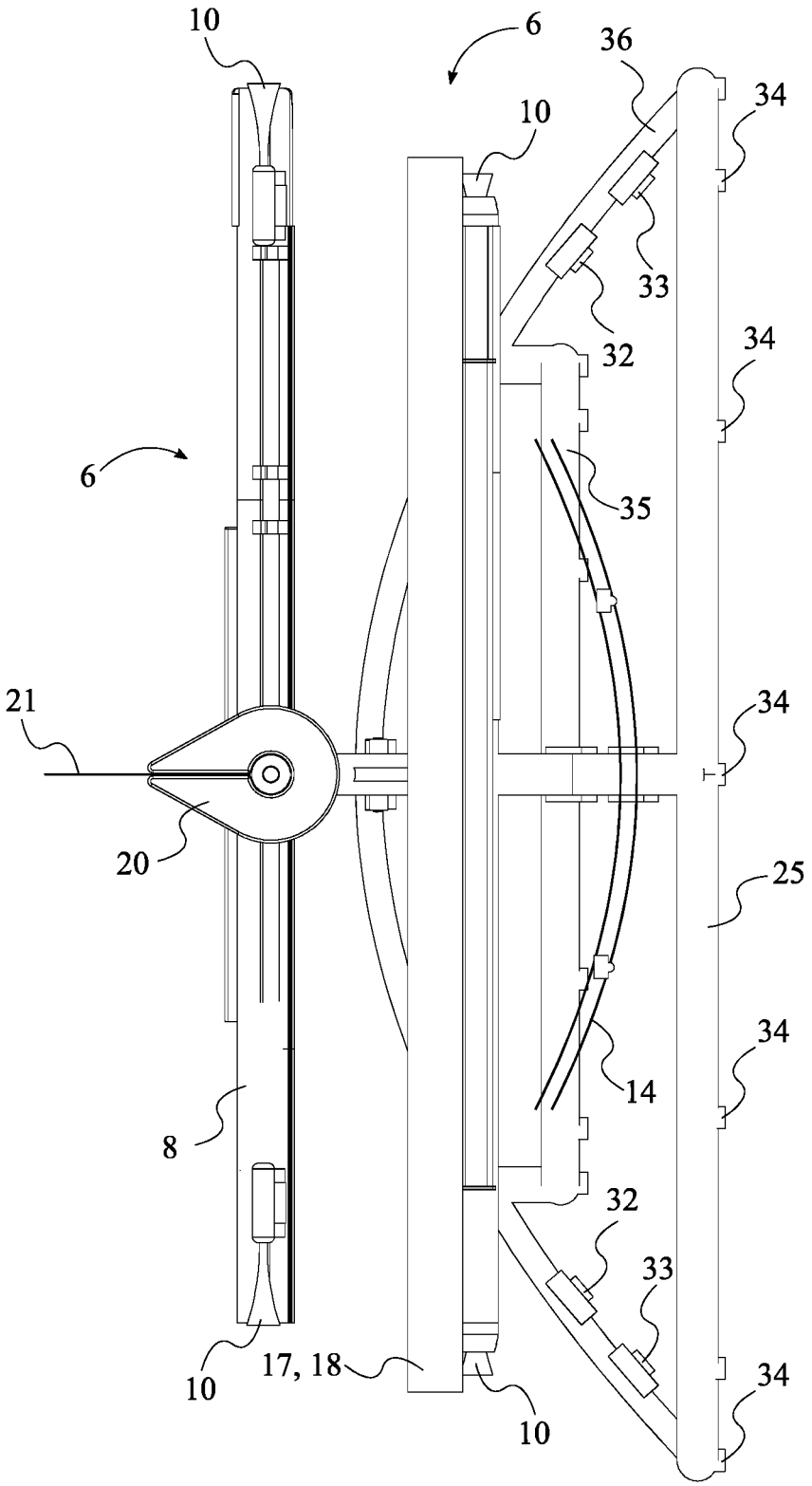
FIG. 18 is a bottom view of the present invention with the net removed.
Figure 19:
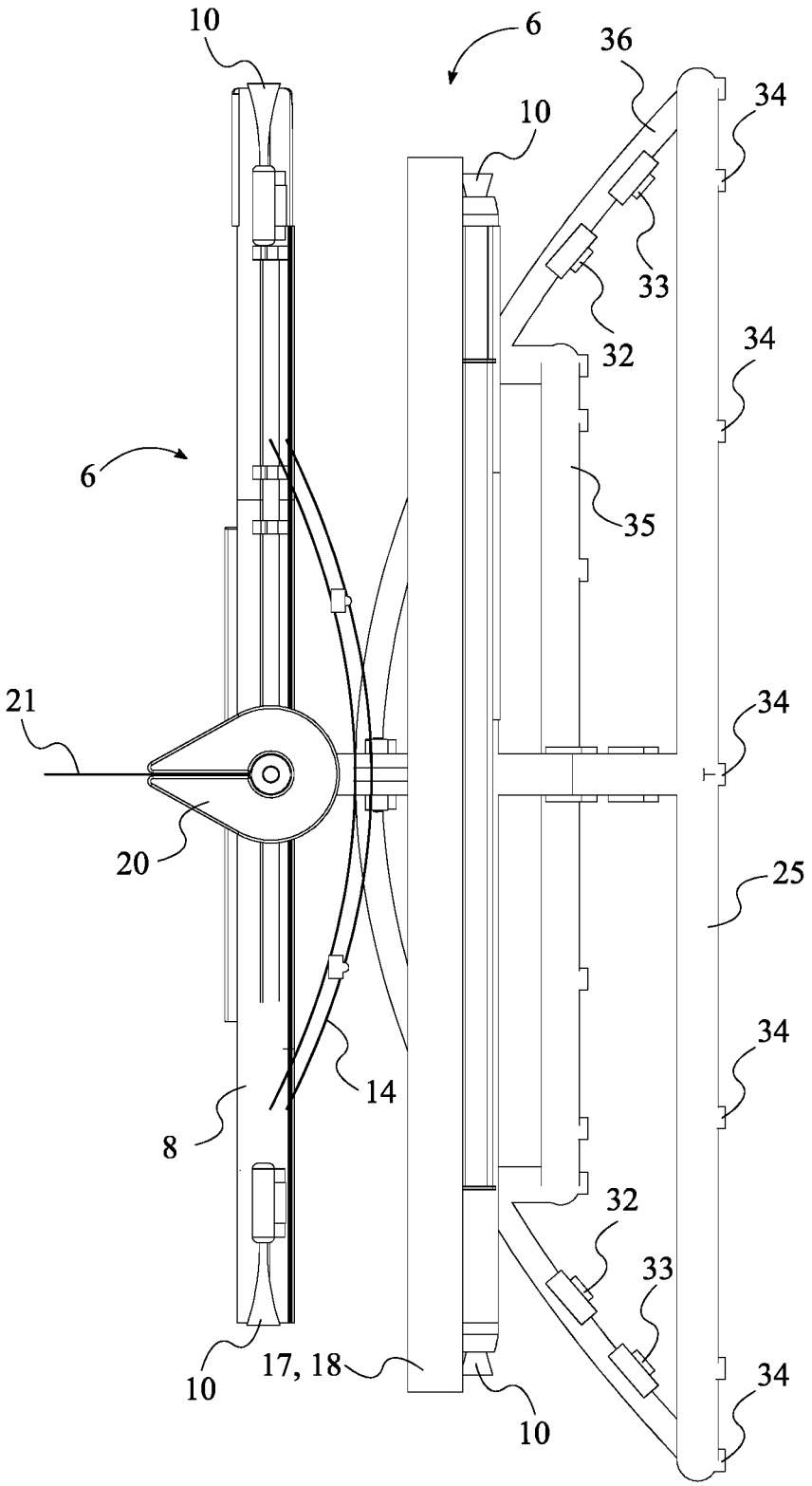
FIG. 19 is a bottom view of an embodiment of the present invention with the camera track mounted onto the support arm.
Figure 20:
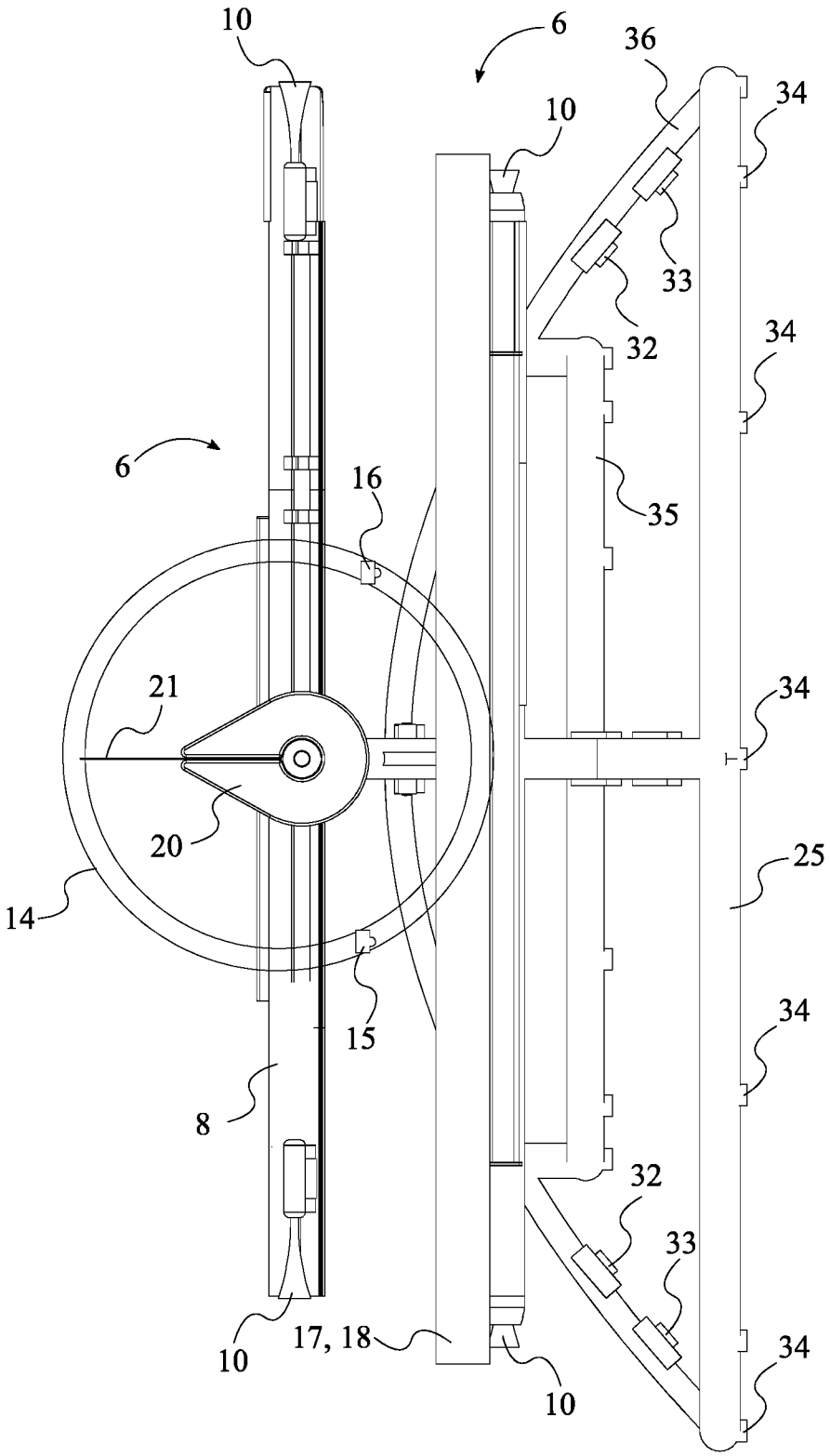
FIG. 20 is a bottom view of an embodiment of the present invention with a circular camera track.

Referring to FIG. 2, FIG. 14, and FIG. 15, in an alternative embodiment the at least one secondary annular frame 35 is a plurality of secondary annular frames 35. In this embodiment, each of the plurality of secondary annular frames 35 is serially positioned and concentrically aligned. Further, the intermediary support frame 36 is connected between each of the plurality of secondary annular frames 35, such that the ball 52 is not hindered from passing through the central portion 26 of the secondary annular frame 35. The secondary annular frame 35 can be repositioned to change the type of sports game being played. For example, the secondary annular frame 35 can be positioned offset from the primary annular frame 25 such that the primary annular display 34 is positioned in between the crowd-facing surface of the secondary annular frame 35 and the primary annular frame 25. In this configuration, the present invention forms a convex goal that tapers from the primary annular frame 25 to the secondary annular frame 35. Conversely, the secondary annular frame 35 can be positioned offset from the primary annular frame 25 such that the primary annular frame 25 is positioned in between the secondary annular frame 35 and the primary annular display 34. In this configuration, the present invention forms a concave goal that tapers from the primary annular frame 25 to the secondary annular frame 35.

Referring to FIG. 2, FIG. 7, and FIG. 22, is described above, the present invention is designed to function as a goal that uses a collection of sensors to track the position of the ball 52 as well as to determine when the ball 52 passes through the central portion 26 of the primary annular frame 25 or the secondary annular frame 35. To accomplish, this the present invention further comprises at least one secondary environmental sensor 37. The at least one secondary environmental sensor 37 is integrated into the secondary annular frame 35. As a result, the at least one secondary environmental sensor 37 is able to monitor the environment around the present invention. Preferably, the at least one secondary environmental sensor 37 is a plurality of environmental sensors that comprises a plurality of motion sensors 30 and a plurality of proximity sensors 31. These sensors enable the present invention to capture multiple types of data and determine if the athlete has scored by passing the ball 52 through the central portion 26 of the primary annular frame 25 or the secondary annular frame 35. To facilitate this, the plurality of motion sensors 30 and the plurality of proximity sensors 31. Additionally, the plurality of motion sensors 30 and the plurality of proximity sensors 31 are oriented toward the central portion 26 of the primary annular frame 25. As a result, the present invention is able to capture data from multiple angles and accurately determine when the ball 52 passes through the central portion 26 of the primary annular frame 25 or the secondary annular frame 35.

Referring to FIG. 2, FIG. 4, and FIG. 7, the present invention is designed to gather information about the field of play and then output visualizations of the gathered data. To facilitate this, the present invention further comprises at least one frame cameras 32, and at least one range finder video camera 33, and at least one frame projector 331. The least one frame projector 331 is preferably a 3D hologram projector. However, various other types of projectors including, but not limited to, DLP projectors, long throw zoom projectors, and traditional projectors are suitable as well. The at least one frame cameras 32, the at least one range finder video cameras 33, and the at least one frame projector 331 are pivotably and slidably mounted onto the intermediary support frame 36. Thus, the at least one frame cameras 32, the at least one range finder video cameras 33, and the at least one frame projector 331 are capable of being repositioned to capture, or project into, various parts of the stands, the sky, and the field. Additionally, if two copies of the present invention are being used as the goals for a sports game, then the at least one frame projector 331 of the first copy can be used to project information onto the second copy that is positioned across the field of play.

The secondary annular frame 35 is designed to incorporate all of the environmental sensing and information delivering capabilities of the primary annular frame 25. To facilitate this, the present invention further comprises a secondary annular display 42. The secondary annular display 42 is integrated into the secondary annular frame 35, such that the secondary annular display 42 is concentrically aligned to the secondary annular frame 35. As a result, various sections of the secondary annular display 42 can be lighted to visually output information and advertisements. Similar to the primary annular display 34, the operations of the secondary annular display 42 can be coordinated with the at least one secondary environmental sensor 37 to automatically alert the athlete when the ball 52 passes through the central portion 26 of the primary annular frame 25 or the secondary annular frame 35. Preferably, the secondary annular display 42 comprises a plurality of LEDs that is distributed across the exterior surface of the primary annular display 34.

Figure 21:
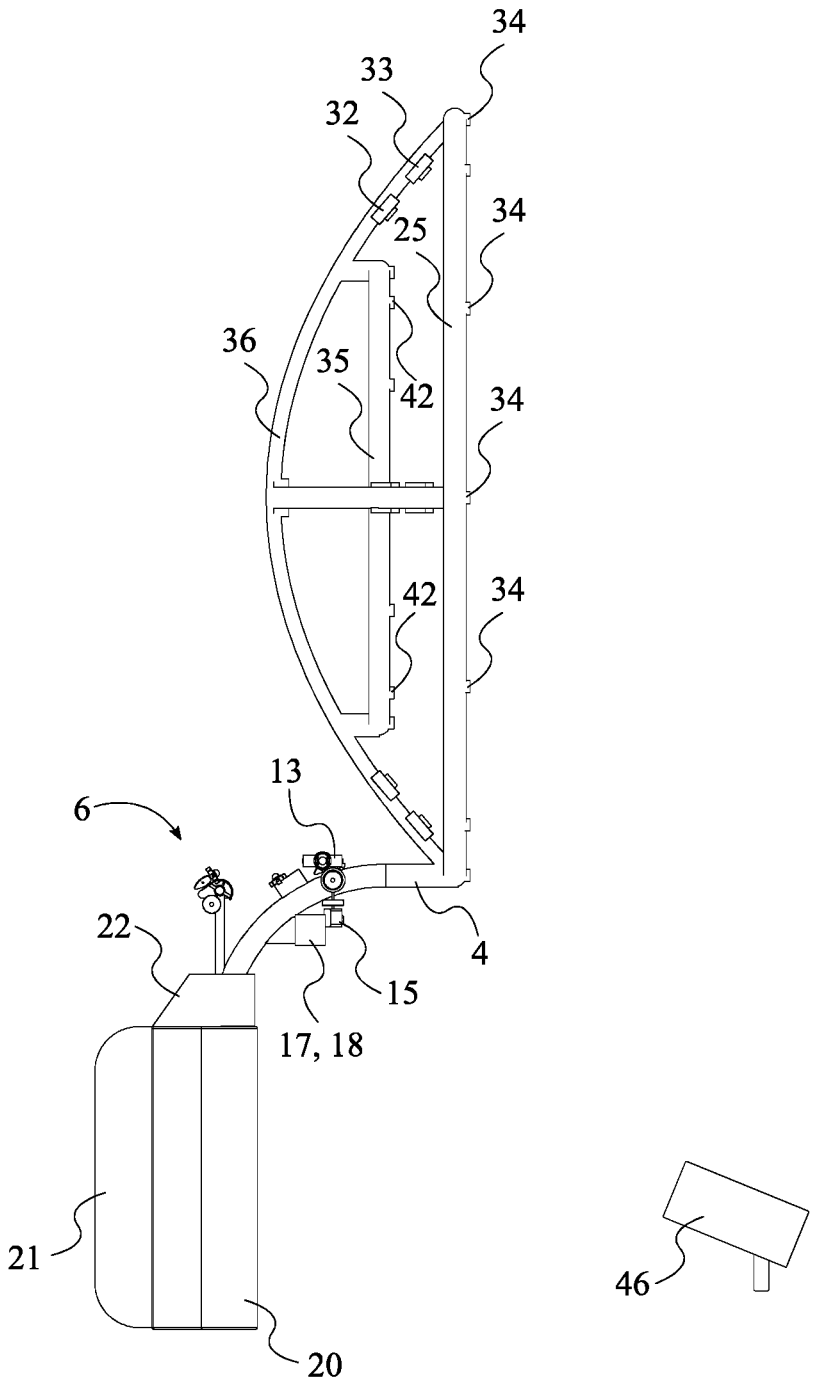
FIG. 21 is a left-side view of the present invention with the net removed.

Referring to FIG. 1, FIG. 4, and FIG. 21, the present invention is designed to deliver large amounts of information to stadium-sized crowds. To facilitate this, the present invention further comprises at least one secondary projector 43. The secondary projector 43 is preferably a 3D hologram projector. However, various other types of projectors including, but not limited to, DLP projectors, long throw zoom projectors, and traditional projector are suitable as well. Preferably the secondary projector 43 is mounted offset from the secondary annular frame 35. To facilitate this, the intermediary support frame 36 is connected in between the primary annular frame 25 and the support assembly 1. Additionally, secondary projector 43 is mounted onto the connection between the intermediary support frame 36 and the support assembly 1. Thus, the secondary projector 43 is maintained in a position that facilitates projecting a holographic image within the central portion 26 of the primary annular frame 25 and the secondary annular frame 35. Preferably, the secondary projector 43 is designed to be pivotably and slidably mounted onto the intermediary support frame 36. Thus mounted, the secondary projector 43 can be used to project images into the stands, the sky, or the field as well. Additionally, if two copies of the present invention are being used as the goals for a sports game, then the secondary projector 43 of the first copy can be used to project information onto the second copy that is positioned across the field of play.

Referring to FIG. 2, FIG. 7, and FIG. 15 through FIG. 17, the present invention is designed to be used with or without a physical net. To achieve this functionality, the primary projector 28 and the secondary projector 43 are used to project 3D holograms into the central portion 26 of the primary annular frame 25 and the secondary annular frame 35. These 3D holograms can take the shape of a net, a target, or any other desired object. Thus, serving as visual cues for the athlete when trying to score. However, embodiments of the present invention comprise a net 44, a first plurality of sensor-integrated fasteners 45, and a second plurality of sensor-integrated fasteners 451. The net 44 is mounted onto the primary annular frame 25 and is positioned over the central portion 26 of the primary annular frame 25. Accordingly, the net 44 functions as a backstop that catches the ball 52 after passing through the central portion 26 of the primary annular frame 25. Some embodiments of the present invention are designed with various types of nets 44 including, but not limited to elastic nets, target rebound nets, semi-rigid nets, chain-link nets, and fabric nets. Each of the first plurality of sensor-integrated fasteners 45 and the second plurality of sensor-integrated fasteners 451 is a fastener that can detect movement or pressure being applied to an external device to which the sensor-integrated fastener is connected. Preferably, each of the sensor-integrated fastener is a hook. The first plurality of sensor-integrated fasteners 45 is radially distributed around the primary annular frame 25. Additionally, the first plurality of sensor-integrated fasteners 45 is connected in between the primary annular frame 25 and the net 44. As a result, the first plurality of sensor-integrated fasteners 45 is able to retain the net 44 in a desired position, and to detect when the ball 52 actually touches the net 44. Likewise, the second plurality of sensor-integrated fasteners 451 is radially distributed around the secondary annular frame 35. Additionally, the second plurality of sensor-integrated fasteners 451 is connected in between the secondary annular frame 35 and the net 44. As a result, the second plurality of sensor-integrated fasteners 451 is able to retain the net 44 in a desired position, and to detect when the ball 52 actually touches the net 44. Once the ball 52 touches the net 44, the primary annular display 34 and the secondary annular display 42 may be activated to notify the athlete of a successful goal.

In an alternative embodiment, the net 44 is suspended in between the secondary annular frame 35 and the intermediary support frame 36. In this embodiment, the intermediary support frame 36 retains the net 44 in a desired configuration. For example, the intermediary support frame 36 retains the net 44 in a flared configuration such that the ball 52 is caught by the net 44 after passing through the central portion 26 of the secondary annular frame 35. Some embodiments feature sensor-laden nets 44 with integrated lights. In a separate, alternative embodiment, the net 44 is a flat, round, and transparent display device. In this embodiment, the transparent display is mounted onto the intermediary support frame 36.

Preferably, the primary annular frame 25 and the secondary annular frame 35 are circular rings. However, alternative embodiments are designed to feature annular frames of varying shape and size including, but not limited to, rectangular, triangular, oblong, and star-shaped. Additionally, the primary annular frame 25, the secondary annular frame 35, and the intermediary support frame 36 are preferably constructed from tubular members using materials including, but not limited to, metal, steel, Aluminum, Carbon fiber, PVC, Glass, and Wood. Alternative embodiments of the present invention are constructed such that the primary annular frame 25, the secondary annular frame 35, and the intermediary support frame 36 form a truss system.

Figure 9:
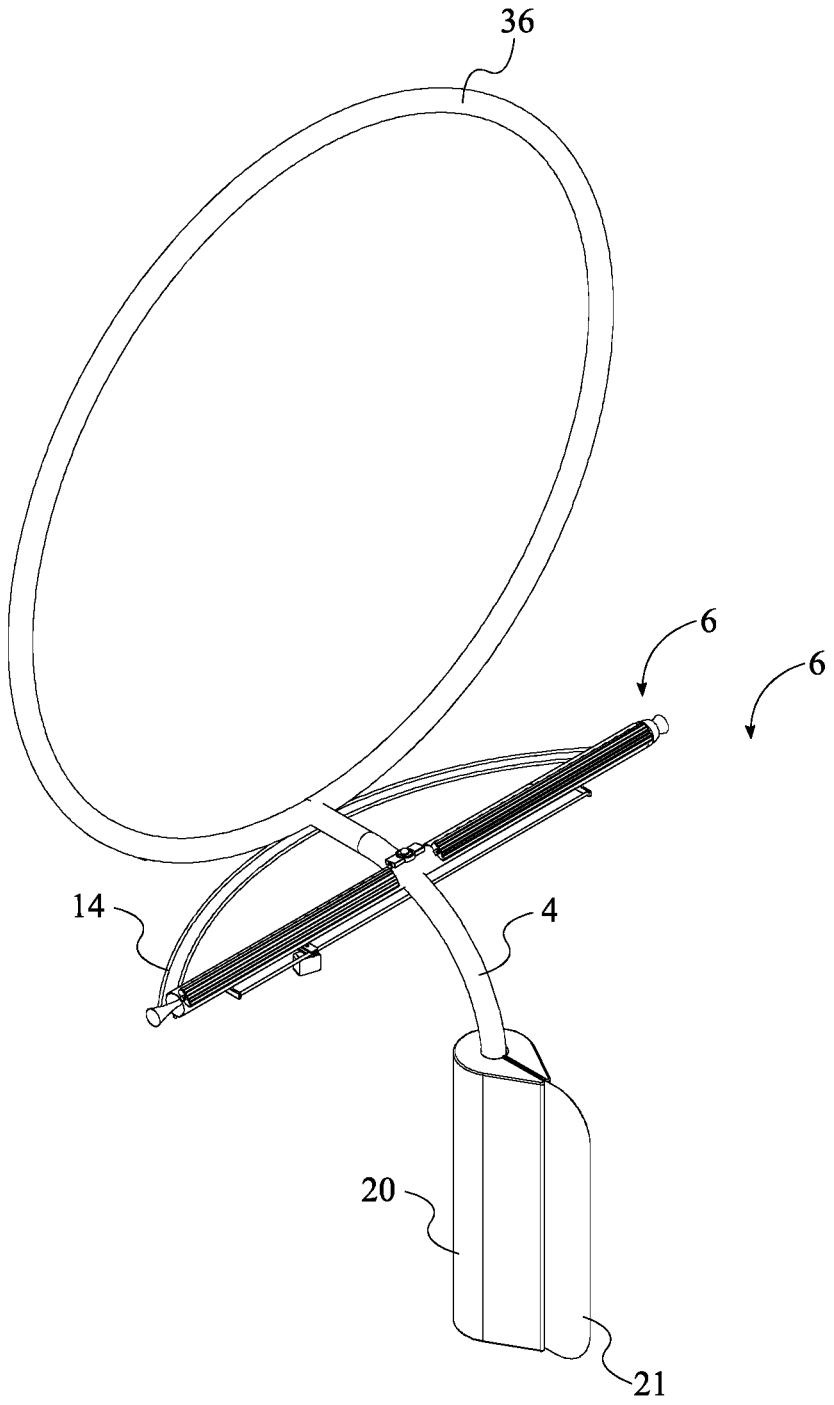
FIG. 9 is a rear perspective view of an embodiment of the present invention where the secondary annular frame is removed.
Figure 10:
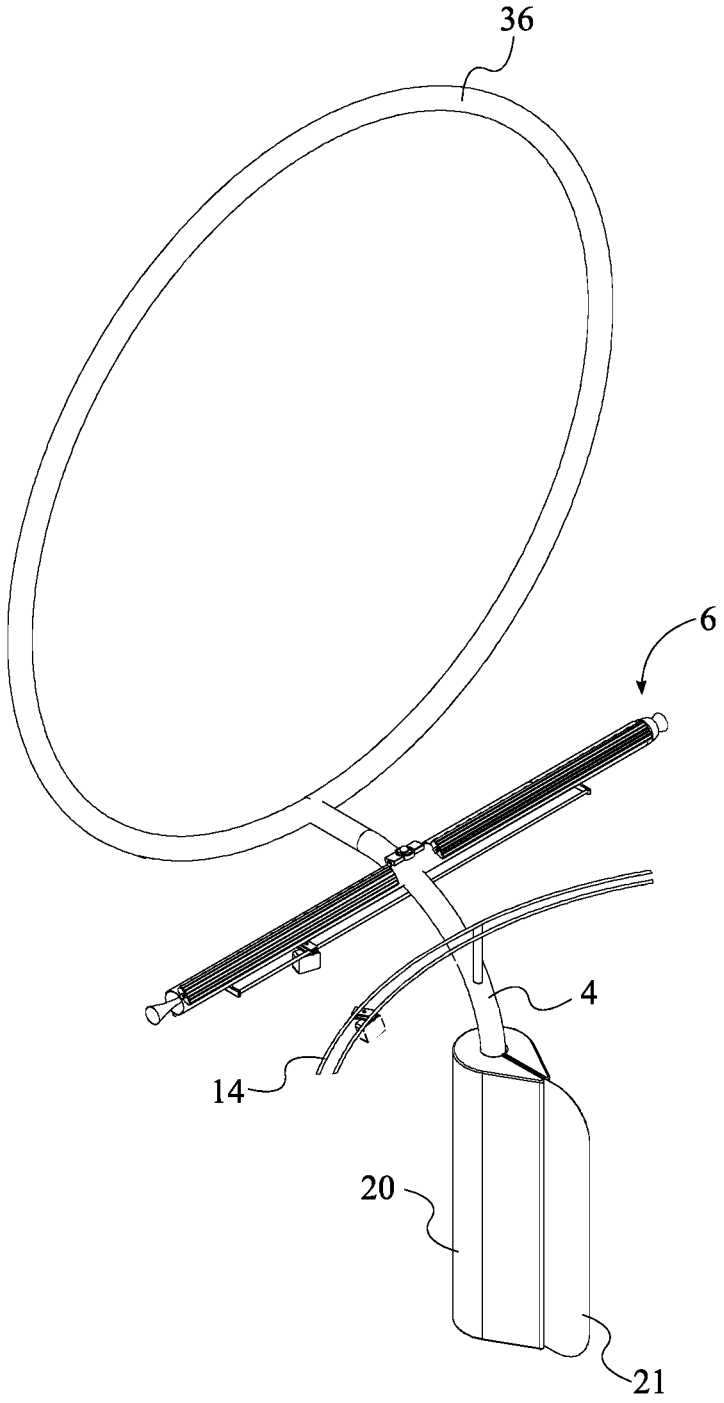
FIG. 10 is a rear perspective view of an embodiment of the present invention where the secondary annular frame is removed. In this embodiment, the camera track is mounted behind the adjustable support post.
Figure 11:
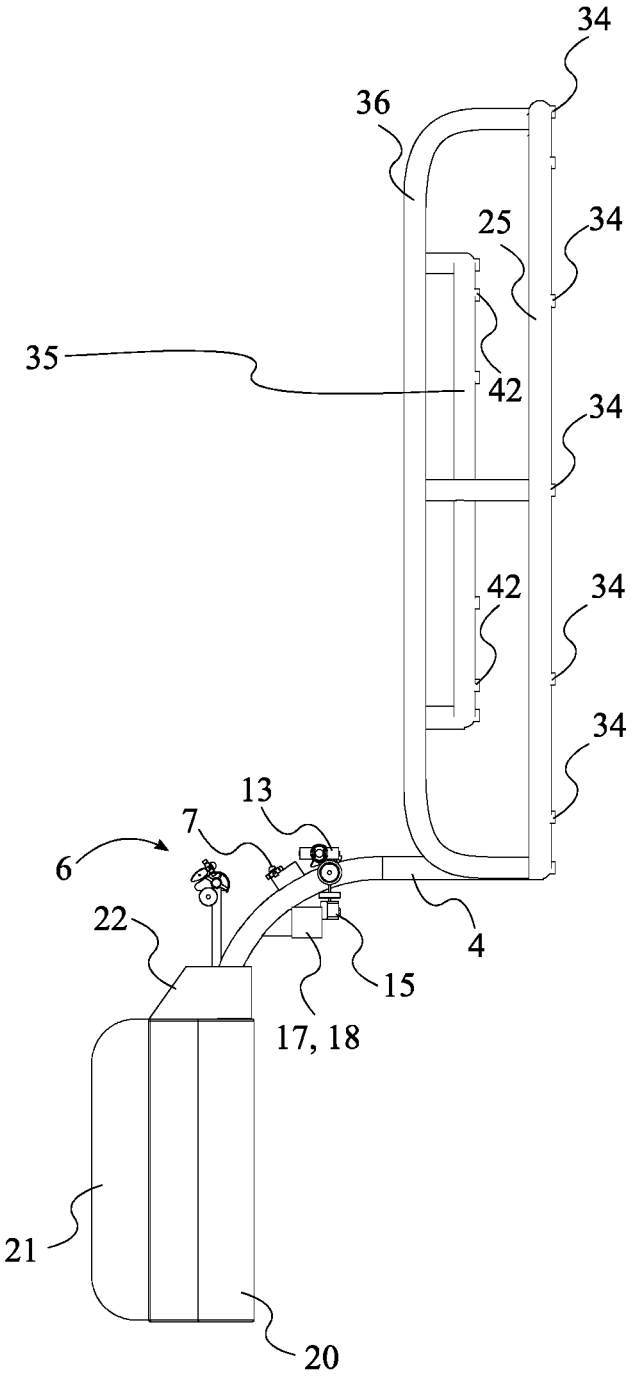
FIG. 11 is a left-side view of an embodiment of the present invention with a flat intermediary support frame.
Figure 12:
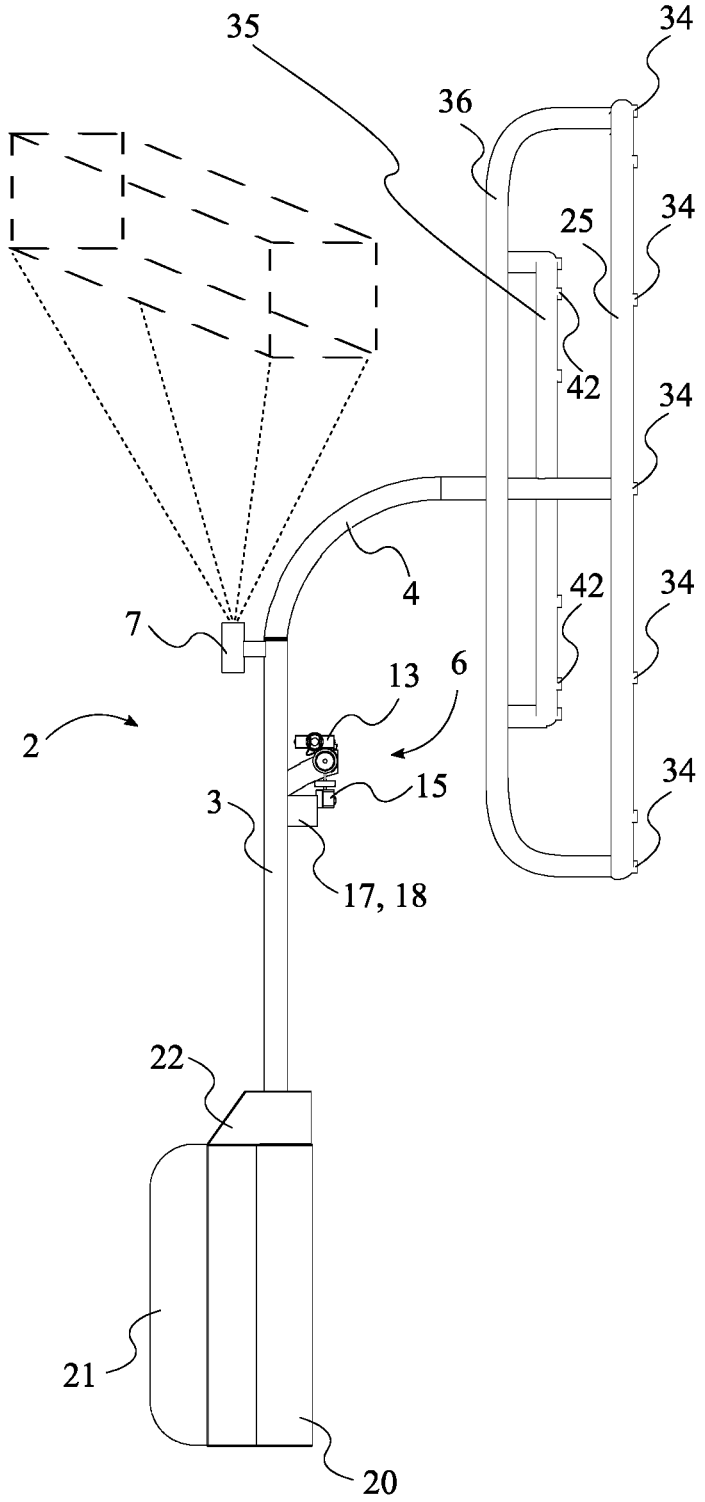
FIG. 12 is a left-side view of an embodiment of the present invention with a flat intermediary support frame. In this view the dotted lines indicate a holographic projection.
Figure 13:
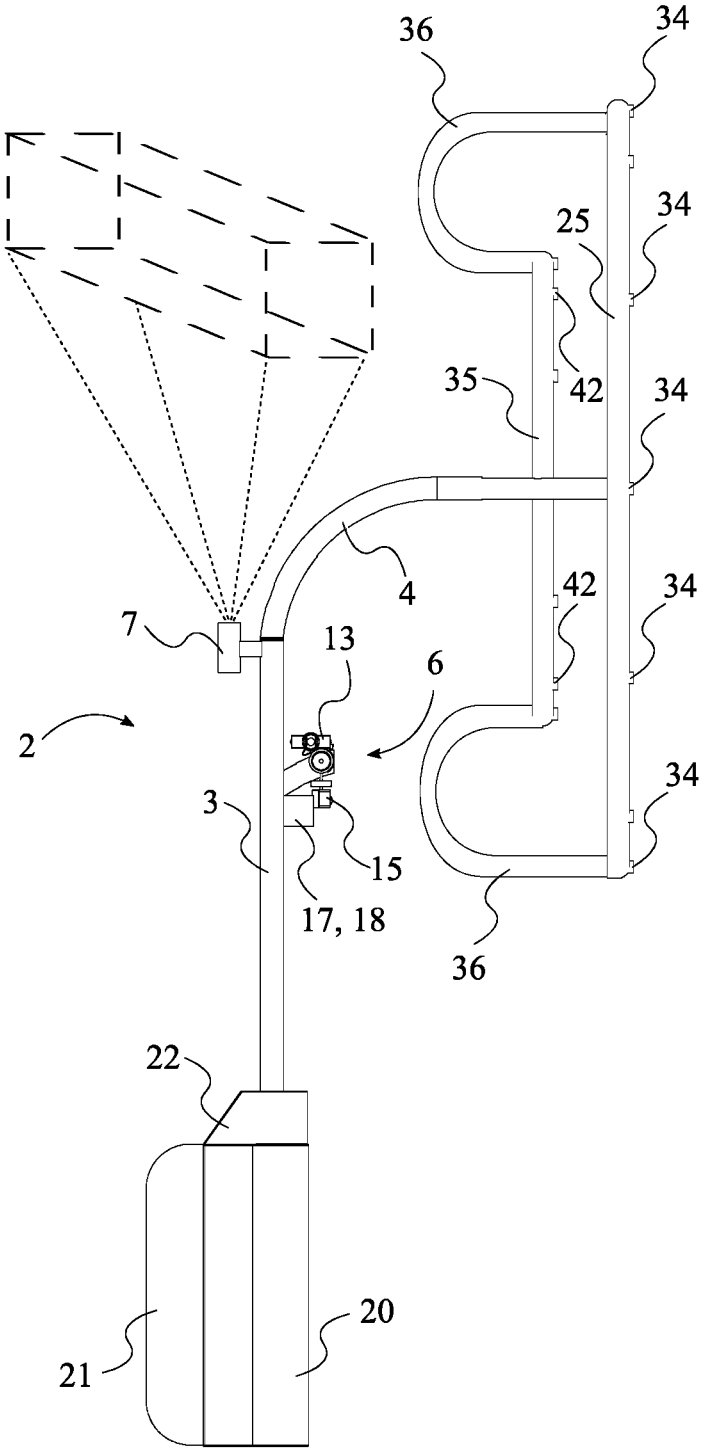
FIG. 13 is a left-side view of an embodiment of the present invention where the adjustable support arm is connected to the center of the intermediary support frame.

Referring to FIG. 2, and FIG. 9, and FIG. 14, as described above, the support assembly 1 is designed to maintain the primary annular frame 25, the secondary annular frame 35, and the multimedia bar system 6 in orientations that facilitate playing the sports game and providing information to the athlete and the audience. To accomplish this, the support assembly 1 comprises at least one support post 3 and at least one adjustable support arm 4. The support post 3 forms an upright structure that extends between the ground and the adjustable support arm 4. The adjustable support arm 4 is terminally connected to the support post 3, opposite to the ground. Additionally, the primary annular frame 25 is mounted onto the adjustable support arm 4, opposite to the support post 3. As a result, the adjustable support arm 4 maintains the primary annular frame 25 in a position that facilitates playing the sports game. Preferably, the adjustable support arm 4 is a gooseneck mechanism that enables the primary annular ring to be displaced, as desired. Some embodiments of the present invention are designed with pivotable connections between the adjustable support arm 4, the support post 3, and the primary annular frame 25.

In some embodiments of the present invention, the adjustable support arm 4 is laterally connected to the primary annular frame 25. In separate alternative embodiments, the adjustable support arm 4 is connected to the intermediary support frame 36. In further embodiments the adjustable support arm 4 is slidably mounted onto the support post 3. This slidable connection enables the distance between the primary annular frame 25 and the ground to be increased or decreased, as desired. Preferably a motorized system is integrated into the support post 3 and the adjustable support arm 4. Thus, enabling the primary annular frame 25 to be repositioned when receiving commands from a controller device. Preferably, one end of the support post 3 is mounted into an underground sleeve. However, some embodiments feature support posts 3 that are secured using various types of mounting devices including, but not limited to, movable bases and pivotable joints. An alternative embodiment of the present invention further comprises a solar platform base 5. The solar platform base 5 is a mounting system that transforms solar energy into electrical power. The solar platform base 5 is terminally mounted onto the support post 3, opposite to the adjustable support arm 4. Accordingly, the solar platform base 5 maintains the support post 3 in an upright orientation while providing electrical power to the electrical components of the present invention.

Figure 5:
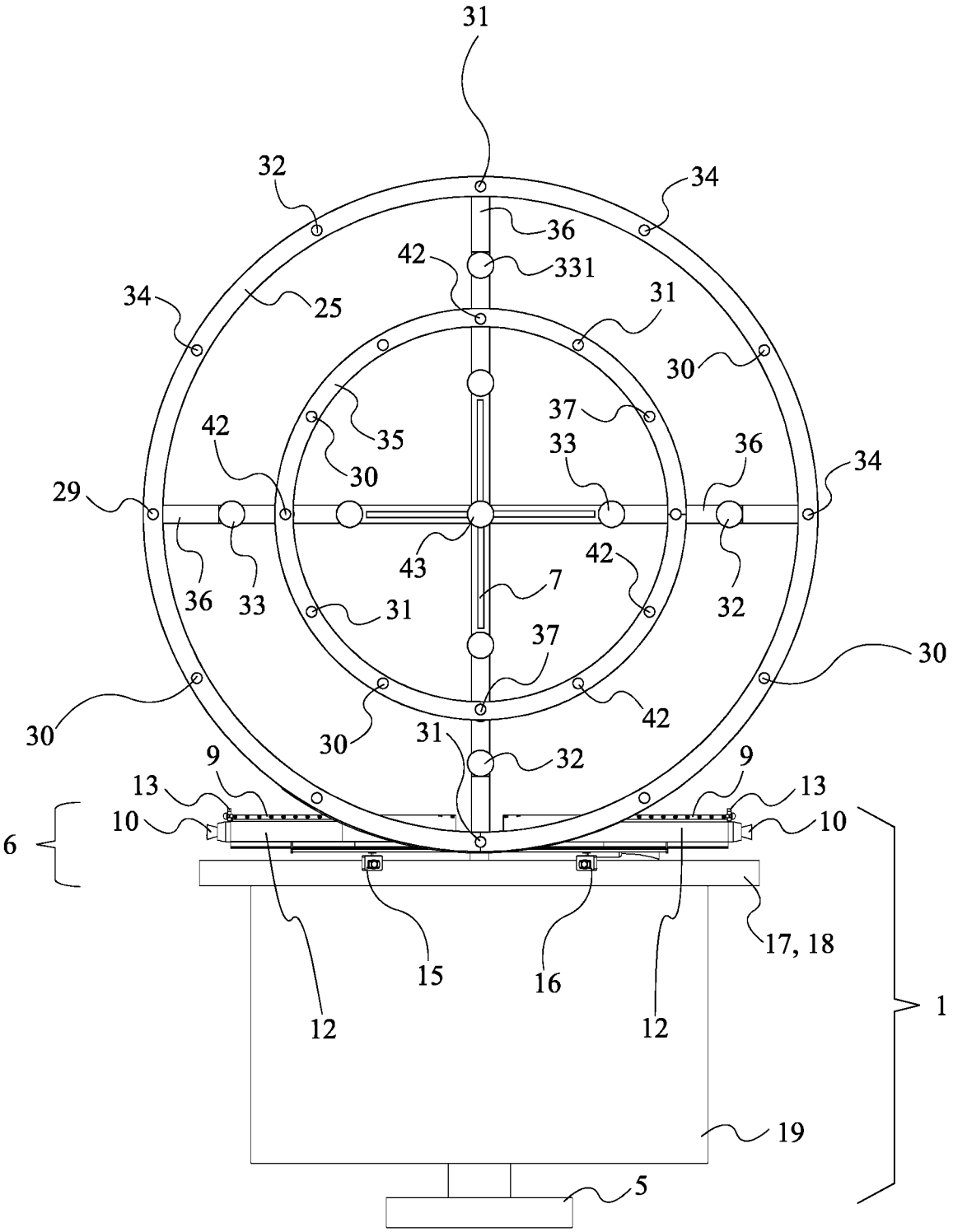
FIG. 5 is a front view of an embodiment of the present invention. In this view the screen is in an extended configuration.
Figure 6:
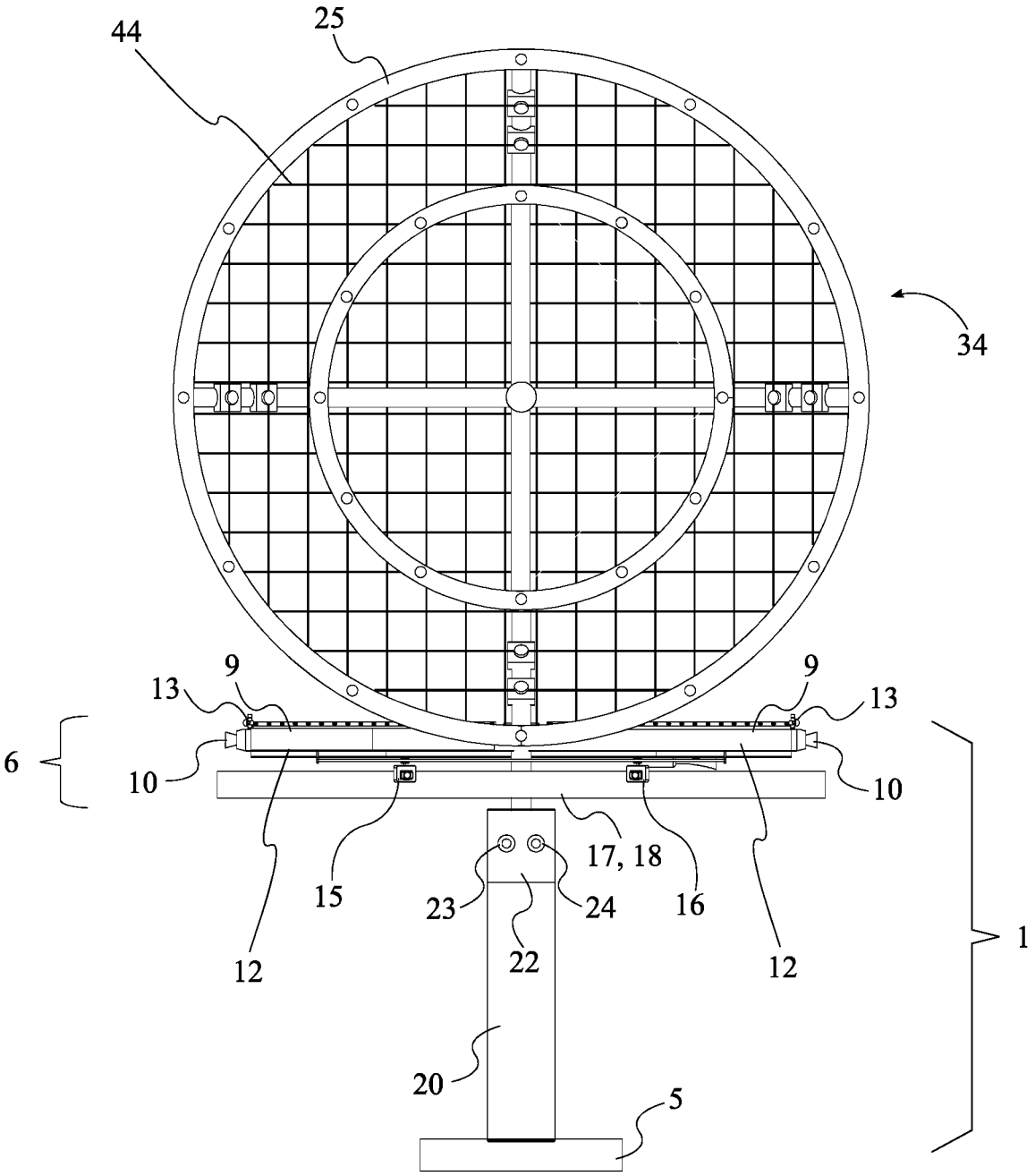
FIG. 6 is a front view of an embodiment of the present invention with a traditional net.

Referring to FIG. 2, FIG. 4, and FIG. 5, the present invention is designed to protect the athlete while providing real-time information about the sports game. To achieve this functionality, the present invention further comprises an airbag padding system 20, a foldable display 21, at least one support speaker 22, at least one support camera 23, and at least one support projector 24. The airbag padding system 20 is a protective liner that is laterally mounted around the support post 3. As a result, the force of a collision between the athlete and the support post 3 is absorbed by the airbag padding system 20. Thus, preventing the athlete from being injured. Preferably, the airbag padding system 20 is operatively coupled to the proximity sensor, such that the airbag padding system 20 is used to deploy an airbag as a player approaches impact with the support assembly 1. Additionally, the airbag is deployed away from the support post 3 to further prevent injury from the collision. In some embodiments a flexible LED screen is superimposed onto the airbag padding system.

The foldable display 21 is system comprises a first screen and a second screen that are hingedly connected. The foldable display 21 is laterally mounted onto the support post 3. Additionally, the foldable display 21 is positioned laterally offset from the airbag padding system 20. As a result, the foldable display 21 is able to transition from an extended configuration and a retracted configuration. While in the extended configuration, the first screen and the second screen are positioned on opposite sides of the airbag padding system 20. While in the retracted configuration, the first screen and the second screen are positioned adjacent to each other and nestled behind the airbag padding system 20. The foldable display 21 functions as an additional medium through which advertisement and other similar content may be displayed to the audience. Preferably, each screen of the foldable display 21 uses screen display technology that employs a panel of LEDs as the light source. Alternatively, the foldable display 21 may be a banner/sticker with advertisement content. The support speaker 22 is laterally mounted onto the support post 3. Additionally, the support camera 23 and the support projector 24 are laterally mounted onto the support speaker 22. Further, the support projector 24 is positioned offset from the support camera 23, across the support speaker 22. Consequently, the present invention can be used to gather a player's eye view of the field of play. The support speaker 22 is also able to project 2D and 3D images onto the area around the support post 3. In an alternative embodiment the present invention further comprises a soft LED display 53. The soft LED Display 53 is superimposed onto the airbag padding system so that the athletes can see information that is presented on the airbag padding system 20.

The present invention further comprises at least one three-dimensional LED fan projector 7. The three-dimensional LED fan projector 7 comprises a rotating central base, a plurality of LED rails, and a plurality of blades. The rotating central base houses the electronic components needed to power and control the plurality of LED rails. The plurality of blades supports and rotate the plurality of LED rails in order to create hologram images. Specifically, the plurality of blades is radially distributed about the rotating central base with each of the plurality of blades being terminally connected to the rotating central base. Each of the plurality of LED rails include a linear set of LED lights for producing visual effects. Each of the plurality of LED rails is connected adjacent and along a corresponding blade from the plurality of blades. Resultantly, the plurality of blades and the plurality of LED rails are capable of spinning with the rotating central base. At high rotations per minute, the plurality of LED rails can be activated to produce images with the plurality of blades being essentially invisible, thus creating a hologram effect. The three-dimensional LED fan projector 7 is mounted onto the intermediary support structure 36. Additionally, the three-dimensional LED fan projector 7 is oriented toward the primary annular frame 25. Thus positioned, the three-dimensional LED fan projector 7 projects 3D images into the audience. Some embodiments of the present invention are designed with LED strips that are laterally mounted onto the intermediary support frame 36. Thus, enhancing the informational output of the present invention.

Referring to FIG. 2, FIG. 4, FIG. 5, and FIG. 7, the multimedia bar system 6 provides an alternative means of conveying the score of the game to the audience and the players of the game. In particular, the multimedia bar system 6 conveys the score of the game through an audible and visual medium. When a team scores a goal during the game, the present invention activates and produces an audible and visual representation. In order to ensure that the multimedia bar system 6 does not get damaged during game play, the multimedia bar system 6 is positioned behind the primary annular frame 25. The multimedia bar system 6 comprises a support bar 8, a plurality of lights 9, and a plurality of first speakers 10. The support bar 8 structurally supports the plurality of lights 9 and the plurality of first speakers 10. The support bar 8 is oriented parallel to a transverse plane of the primary annular frame 25 and mounted offset from the primary annular frame 25. Additionally, the support bar 8 can be designed in various shapes including, but not limited to straight, curved, rectilinear, and helical. The plurality of lights 9 provides visual effect for the present invention and is distributed along the support bar 8; wherein each of the plurality of lights 9 is adjacently connected to the support bar 8. It is preferred that each of the plurality of lights 9 is a long row of powerful and waterproof stadium light emitting diodes (LEDs), protected by a grill guard mounted over the multimedia bar system 6, although alternative devices may also be utilized. The plurality of lights 9 may be used to depict the current score between opposing teams. Each time a goal is scored, a specific light from the plurality of lights 9 is turned on, wherein the specific light is associated with the corresponding scoring team. The plurality of first speakers 10 provides the audible effect for the present invention and is distributed along the support bar 8; wherein each of the plurality of first speakers 10 is adjacently connected to the support bar 8. It is preferred that each of the plurality of first speakers 10 is a powerful and waterproof siren. The plurality of first speakers 10 may be used for a variety of purposes including, but not limited to, score announcement, advertisement audio, music, and other similar purposes. It is preferred that each of the plurality of first speakers 10 and each of the plurality of lights 9 are oriented toward the primary annular frame 25 and the center of the field for maximum visibility, although alternative orientation may also be utilized. Preferably, each of the plurality of first speakers 10 comprises an air horn siren system, a compressor, and a trumpet. Additionally, each of the plurality of first speakers 10 is integrated into opposing ends of the support bar 8. Thus, the plurality of first speakers 10 is shielded from the external environment.

In one embodiment of the present invention, the multimedia bar system 6 further comprises a plurality of sponsor display panels 12. The plurality of sponsor display panels 12 provides an additional medium through which advertisement and other similar content may be displayed to the audience. Preferably, the plurality of sponsor display panels 12 use screen display technology that employ a panel of LEDs as the light source. That is, the plurality of sponsor display panels 12 use any electronic and digital advertising display and projection technology. Alternatively, the plurality of sponsor display panels 12 may be a banner/sticker with advertisement content. The plurality of sponsor display panels 12 is distributed along the support bar 8 with each of the plurality of sponsor display panels 12 being adjacently connected to the support bar 8. Each of the plurality of sponsor display panels 12 may be an electronic display device or a banner/sticker with advertisement content. The multimedia bar system 6 and other electronic components of the present invention may be directly connected to a power outlet, a battery source, a power generator, or other similar sources.

In the preferred embodiment of the present invention, the multimedia bar system 6 further comprises an at least one pivoting projector device 27. The pivoting projector device 27 displays content about and around the present invention. The pivoting projector device 27 is centrally and externally mounted to the support bar 8. Additionally, the pivoting projector device 27 may be protected by a guard cover. The pivoting projector device 27 may be oriented towards the ground and projects three-dimensional images. Alternatively, the pivoting projector device 27 may display content directly above the present invention. In general, the pivoting projector device 27 is a multidirectional system capable of rotating and tilting in order to display a three-dimension hologram anywhere around the present invention. The pivoting projector device 27 may be oriented towards the sky, above the field, and above the stadium goal frame, in particular towards the top center of the sport stadium field to project large and very large three-dimensional images floating in mid-air to be seen from any angle and from under or above the present invention during live sport events. This is not limited to professional sports events and discipline from all types of professional sports, including water sports and no water sports. Type of content that the pivoting projector device 27 may display information including, but is not limited to, sponsor logo, company products, replays of the most recent goal, three dimensional images of sports team and player t-shirt, jersey or sports team logo associated with the most recent scored goal, advertisements, and other similar content. A hologram programmer or other administrative staff is in charge of content being displayed by the pivoting projector device 27. More specifically, a field official controller or an operation center from the sport organization and professional club staff are in charge to manage both team's Jersey/T-shirts and sponsor logo and ready for projection when a goal is officially scored upon the field official referee approval.

In one embodiment of the present invention, the pivoting projector device 27 is a long zoom projector. The long zoom projector is a projecting device with a long-range zoom lens capable of projecting images, videos, texts messages, and three-dimensional holograms across the field to an opposing goal post. For this, the opposing goal post may also include a transparent screen for receiving the images from the long zoom projector. The long zoom projector displays content onto and or above the opposing goal post such as official scoring announcements, advertising, products, sponsor logo, country flags, team logos, time, scoring, announcement of change of player, and video advertising to name a few non-limiting examples.

In one embodiment of the present invention, the pivoting projector device 27 is a mapping projector device. the mapping projector device utilizes specialized projection technology to turn any surface into a dynamic display. For the present invention, the mapping projector device may be mounted anywhere within the stadium and field of play and may be oriented towards any surface. For example, in one embodiment, the mapping projector device is suspended on a cable system above the field of play and is oriented towards the ground such that content may be displayed directly on the field of play for the audience to see. A similar effect may be achieved by mounting the mapping projector device to a drone that flies anywhere within the stadium. In one embodiment of the present invention, the pivoting projector device 27 is a laser beam projector. In some embodiments the present invention further comprises at least one pivoting camera, at least one second speaker, and at least one end projector 13. The pivoting camera is terminally mounted onto the support bar 8 so that the pivoting camera can have an unobstructed view of the field of play. The second speaker is integrated into the support bar 8 to enable the multimedia bar 6 to produce large amounts of sound in multiple directions. Preferably, the second speaker comprises an air horn siren system, a compressor, and a trumpet. The end projector 13 is pivotably and terminally mounted onto the support bar 8.

Referring to FIG. 2, FIG. 4 through FIG. 9, and FIG. 21, the multimedia bar system 6 is designed to enable the present invention to provide multiple forms of feedback and information to the athlete and the audience. To achieve this functionality, the multimedia bar system 6 further comprises a camera track 14, at least one rangefinder laser-detector video camera 16, and at least one panoramic camera 15. The rangefinder laser-detector video camera 16, the panoramic camera 15, and the camera track 14 capture gameplay from a variety of angles along the support bar 8. The camera track 14 is an elongated rod(s) that provides the rangefinder laser-detector video camera 16 and the panoramic camera 15 a means of translating along the support bar 8 for a variety of footage angles. Further, the camera track 14 can be designed in various shapes including, but not limited to straight, curved, rectilinear, and helical. The camera track 14 is positioned parallel and offset to the support bar 8. Additionally, the camera track 14 is mounted along the tubular body. The rangefinder laser-detector video camera 16 and the panoramic camera 15 are slidably mounted to and along the camera track 14. This allows the rangefinder laser-detector video camera 16 and the panoramic camera 15 to capture gameplay from a variety of heights. Additionally, it is preferred that the rangefinder laser-detector video camera 16 and the panoramic camera 15 are pivotably mounted to the camera track 14 to allow for the rangefinder laser-detector video camera 16 and the panoramic camera 15 to pivot while tracking the ball 52. For this, the rangefinder laser-detector video camera 16 and the panoramic camera 15 are oriented towards the primary annular frame 25. In a supplementary embodiment, a second camera track is mounted onto the support post 3. Thus, allowing a second camera and rangefinder to be mounted onto the support assembly 1. In some embodiments the range finder video camera 16 and the panoramic camera 15 are mounted onto the support assembly 1 via various repositionable assemblies including, but not limited to folding arms, rotating arm bars, telescopic camera supports, and any structure and support capable of enabling the range finder video camera 16 and the panoramic camera 15 to move in unlimited orientations, directions, and angles to capture video imaging in any position, moving sideward, upward and downwards. Further, the range finder video camera 16 and the panoramic camera 15 are mounted onto the support assembly 1 to allow the cameras to capture video imaging in a fixed position and while moving.

In yet another embodiment, the present invention further comprises a retractable screen assembly 17 and an at least one external projector device 46. The retractable screen assembly 17 provides a medium upon which graphical content may be displayed. The retractable screen assembly 17 comprises a motorized housing 18 and a screen 19. The screen 19 is a thin sheet of material designed to reflect projected images. In one embodiment, the screen 19 may be semi-transparent; in another embodiment, the screen 19 is not transparent. In further embodiments the screen 19 is a soft/flexible LED screen display (light-emitting diode display) or a screen display technology that uses a panel of LEDs as the light source. The motorized housing 18 stores the screen 19 when not in use in a rolled-up configuration. The retractable screen assembly 17 is integrated into the multimedia bar system 6, thus providing the audience behind and in front of the primary annular frame 25 with a view of the content being displayed thereon. Additionally, the screen 19 is operatively coupled to the motorized housing 18, wherein the motorized housing 18 is used to externally deploy or internally withdrawn the screen 19 from the motorized housing 18. Accordingly, the screen 19 can be retracted into the motorized housing 18 while not in use. The external projector device 46 is mounted offset to the primary annular frame 25 and is oriented towards the screen 19. Accordingly, the external projector device 46 can project images onto the screen 19. In some embodiments the external projector device 46 is a retractable underground projector. The preferred device is a pop-up projector that is integrated into the ground either behind the support assembly 1 or in front of the primary annular frame 25. The retractable underground projector 46 is positioned underground until activated. When activated, the retractable underground projector 46 raises above ground and displays content onto the screen 19. This configuration ensures that no components of the present invention interfere with gameplay or the players within the game. The size of the screen 19, the material composition of the screen 19, and the type of device used as the retractable underground projector 46 is subject to change to meet the needs and preferences of the user. In some embodiments the external projector device 46 is a mapping projector that is mounted above the field of play and projects images onto the field and into the audience.

Figure 8:
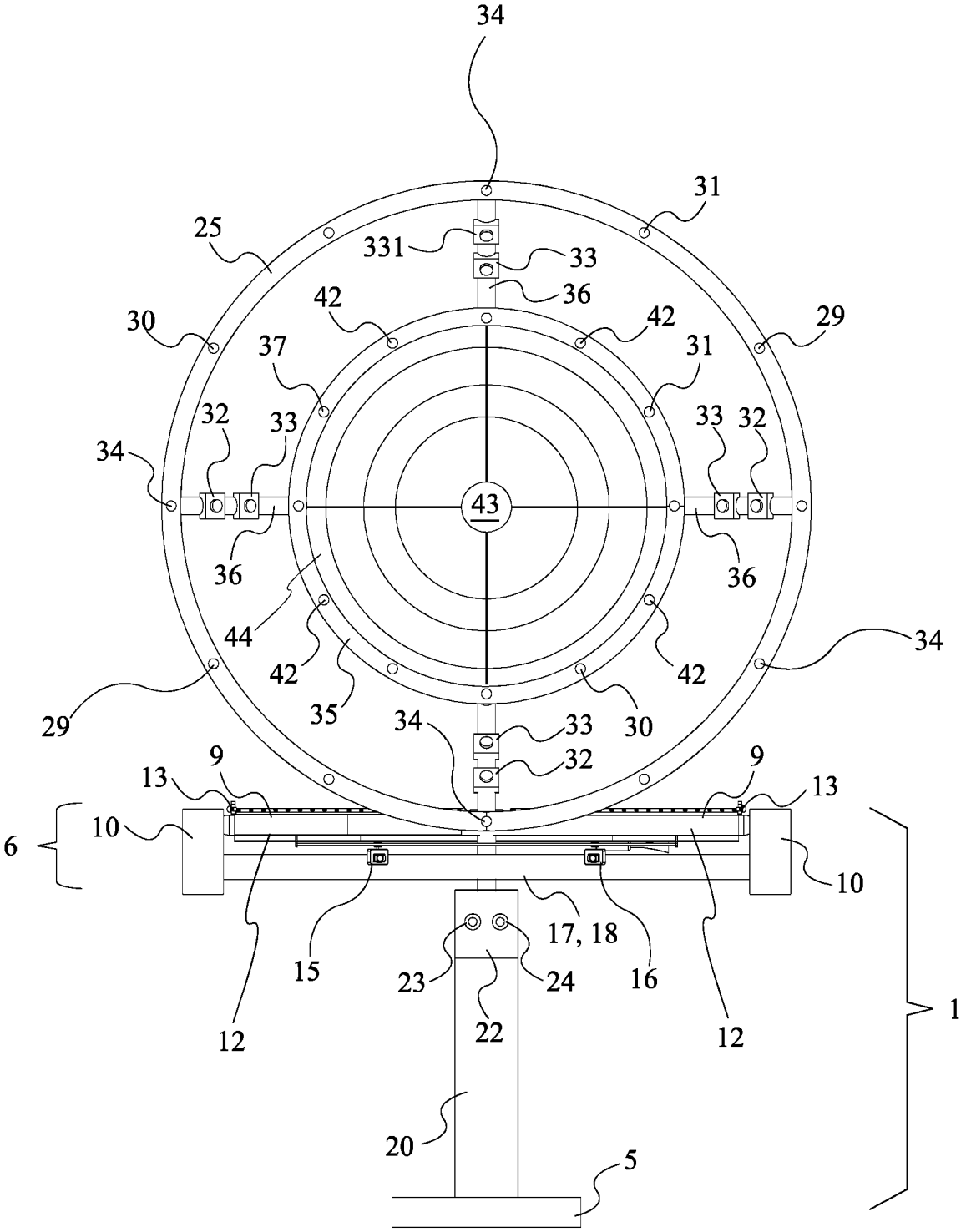
FIG. 8 is a front view of an embodiment of the present invention with a flat display being used as the net.

Referring to FIG. 2, FIG. 7, and FIG. 8, in one embodiment of the present invention, the screen 19 is an LED display, wherein the screen 19 is a flat screen device with an array of LEDs that are selectively activated to display various content such as numbering, video reply, advertising video, images such as company and sponsor logo information, text, various messages, and other similar visual content. The LED screen 19 may rise above the support bar 8 to display content above the present invention. The length, size, and LED concentration is subject to change to meet the needs and preferences of the user. In another embodiment of the present invention, the screen 19 is a display device such as a television or other similar technology. Preferably, the screen 19 can extend below the retractable housing 18.

Referring to FIG. 2, FIG. 4, and FIG. 22, the present invention is designed to work as a networked device that can be communicated with and controlled from remote locations. To facilitate this, the present invention further comprises at least one main computing device 47 and at least one wireless communications system 48. The main computing device 47 is an electrical system capable of performing computational processes and relaying information between a user and the present invention. The wireless communications system 48, the multimedia bar system 6, and all remaining electrical systems included in the present invention are electronically connected to the main computing device 47. Accordingly, the main computing device 47 is able to govern the operation of the electronic components of the present invention. The present invention further comprises at least one human interface device (HID) 49. The HID 49 is mounted onto the support assembly 1 and electrically connected to the main computing device 47. As a result, the user has a physical interface through which to input commands into the present invention, while standing beneath the primary annular frame 25. Preferably, the present invention is a system that further comprises at least one remote server 50 and at least one personal computing (PC) device. The remote server 50 is designed to execute subprocesses as well as run the backend controls for communicating data between the main computing device 47 and the at least one PC device.

Preferably, information that is gathered at the primary annular display 34 is wirelessly transmitted from the wireless communications system 48 to the remote server 50. This information is then distributed to the at least one PC device. For example, audio and video data gathered by the plurality of frame cameras 32 can be transmitted to the remote server 50 and then streamed to a plurality of users through a plurality of PC devices. In some embodiments the plurality of users is able to transmit text and multimedia files to the present invention. This data can them be output by the multimedia bar system 6. In some embodiments a heating system is integrated into the primary annular frame 25. Thus, preventing the system from becoming inoperable due to cold weather conditions. Preferably, the present invention further comprises at least one position tracking unit 51 and at least one ball 52. The position tracking unit 51 is integrated into the ball 52 and communicably coupled to the wireless communications system 48. Accordingly, the main computing device 47 is able to track the position of the ball 52 in or out of the field of play.

In a supplementary embodiment, the support assembly 1 is formed into a racetrack goal. In this embodiment a pair of support posts 3 are positioned on opposite ends of the primary annular frame 25. Additionally, a first and second support beam are connected in between a base of the upright posts and the primary annular frame 25. Further, a retractable cord reel is tethered in between a top of each of the pair of support posts 3 and the primary annular frame 25.

Although the invention has been explained in relation to its preferred embodiment, it is to be understood that many other possible modifications and variations can be made without departing from the spirit and scope of the invention as hereinafter claimed.

Supplemental Descriptions

The present invention is an annular frame device known as the O-Ring goalpost and is to be used for sport and other purpose. It is a revolutionary goalpost sport field equipment and target device made with many electronic technology and digital features mostly for to use of sport. Not limited for animation activities and recreation games, the invention can be mounted anywhere, any surface, any frame and structures use with any number of players to perform target practice activity to improve precision by hand throwing and goal kick using any type of traditional ball, object, instrument and devices, including the use of digital balls technology. With the O-Ring goalpost comes a new sport called Hand Football, a new revolutionary sport using the annular frame goalpost structure mounted on a field play and pitch.

Both the O-Ring goalpost are connected to each other with the electronic line mark field play or pitch between them, all design to work together to keep tracking the game play and action during a live game and also use for entertainment purpose. The electronic and lighting strip system line mark technology is integrated or incorporated to the Line marking of sports fields, to any artificial turf or natural grass or wood and rubber ground surface, this electronic line mark technology is not limited for any sport using any types of field play or pitch, in outdoor and indoor stadiums or arena, courts, race track, etc, to name a few: include field play for American and Canadian football, soccer field, rugby, tennis, baseball, handball, cricket, lacrosse, field and ice hockey, basketball, track and field.

This electronic and digital lighting line mark system for Field or Pitch are design to light up on any sport field play and pitch during any live sport events, the line mark such as the hash lines, yard lines, side lines, end zone, goal lines, half field mark, circle center line, corner marks, any line mark layout made between the goal lines marks, the base line and between the goalposts.

The line marks can light up in various colors and be flashing, this offer the ability to inform the position of the ball or game play on the field play and also use for entertainment purpose.

The O-Ring goalpost includes multitudes of electronic and digital technologies integrated to the annular frame known as the O-Rings goalpost. Specifically, the present invention includes multimedia advertising and sponsor technology, Scoring entertainment system, LED displays, three-dimensional (3D) hologram projectors, camera radar detectors devices, laser radar light projectors, long throw zoom projectors. The LED display screen is designed to work together with the above-cited technologies to introduce a new way of scoring, projecting 3D hologram content, outputting player announcements and official sponsor logos, and offering a new and unique scoring entertainment celebration experience. This new sport is designed to be played with two teams on an innovative tradition and electronic field with a pair of O-ring goal, and uses two types of match balls. Hand-football is a new mixed sport that involves multiple sports disciplines uses the latest innovative goalpost technology in a new field layout that employs unique line mark positions. Each athlete will be required to use multiple skills and talents and have the ability to use multiple variation of techniques and sport rules from various sports disciplines. This will enable the play of a unique and revolutionary sport that combines America Football, Soccer, Rugby, Basketball, and Handball. Thus, creating the ultimate field sport of the 21st century. This new sport requires supreme physical and mental ability that has never been developed and used by any amateur or professional athlete. Each athlete must use able to develop and use the entire body and engage all muscle groups in both upper and lower body to perform a large variety of coordination, balance, reflex-intensive, and multi-movements actions. This forces each athlete to learn multiple sport techniques to play this multi-disciplinary sport. Handfootball is new generation of mix sports, making it the sport of the future and exclusively for unique talent so future athletes will become "super elite athletes".

The present invention includes a large variety of technology such as electronic and digital devices. For example, cameras are mounted to the present invention and are designed to capture live broadcasting video from the field of play. This live streaming video content can be used to assist officials when determining if a goal was scored, if a penalty is required and various other conditions on the field play. Additionally, this information can be broadcasted, and record live from any sport event and on any outdoor or indoor facility, using live streaming and simultaneously recorded real-time broadcast to mobile devices and TV Screens. Addition to the live video streaming, the present invention introduces a new technology called live streaming 3D hologram projection.

This live streaming 3D hologram projection technology consists of 3D hologram projections that is floating in mid-air from the O-ring goalpost or not limned to any field goalpost, field play of any sports projecting 3D hologram content that can be seen in midair from any angles and direction or around the O-Ring goalpost and field of play.

The 3 Dimension hologram imaging is transmitted simultaneously in in real time from the goalpost to reach millions of mobile devices and TV Screens by receiving the same live 3D floating imaging in mid-air that pops up from the goalpost and field play, using methods of live 3 Dimension hologram broadcasting technology, 3 D hologram live streaming technology, or any digital 3D hologram technology design to transmit 3D imaging to mobile devices during any live sport events using any goalpost on a field play or pitch.

The 3D hologram projection imaging consists of first introducing the official scoring goal or point by announcing the player and team jersey with his or her name and number that has scored the goal or point by projecting the 3D hologram imaging of the sponsor logo, advertising, company product and names, including entertaining and advertising content projections. The live streaming content and 3D hologram projection live streaming technology is used for covering the live sport events and is designed to share that excitement with the sport fan using mobile devices and TV Screens. The present invention is designed mostly for professional Hand-football tournaments and International championships broadcast to millions of Hand-football fans worldwide.

This method and technology are not limited for other sports and events, amateur and professional sports organized by professional sport leagues and federations The present invention is designed to live streaming from any sport events and on any field of play during live sport event played outdoor or indoor and simultaneously using any recorded broadcasting technology and live streaming technology to be transmitted to mobile device and TV Screen in real time. not limned to virtual broadcast technology.

Both video contents and live streaming contents capture from the scoring goal, including the live 3D hologram contents project it during the live sport event are design for the live scoring goal mobile app and live streaming service to helps sport fans keep up with all the results and scores from their favorite teams with the live content to be transmitted in real time to mobile device via live video live streaming technology, Not limited of the use of any technology and electronic equipment oriented toward the goal line and game play, design to capture live broadcast and Filming production content made from the field stadium goalpost and around the goalpost frame to transmitted the live content from the goalpost on the field play to mobile devices, during the live sport events, sport official matches such as professional sport leagues, and during championship tournaments, This new solution offers new modern methods and advantages addressed to the sport fans so they can at any time received an update of any live professional and amateur sport events to receive a full live scoring goal or point action from the capture live video content and 3D Hologram projection from the goalpost to mobile devices simultaneously, all without having to be a live spectator in the stadium or watching the game on TV Screen. Thus, generating new digital entertainment value.

Also the present invention is design to announce the player and team that has scored a goal or point will be introduce and announced by a 3D hologram projection imaging content project the player's jersey, player uniform, team logo, sponsor logo, advertising image and video contents, including 3D animation, during live sport event to be seen by the live audience in the stadium and the TV viewers can be seen in real time, and transmitted via live streaming and the use of any digital broadcasting technology to mobile devices.

The live scores goal is the accurate and most complete Hand-football app to bringing fastest live Hand-football scores and sport breaking news from the actual annular goalpost and multimedia display live scoring video covering and 3D projection straight to your mobile devices. Not limited to watch the full game from the cameras mounted on the annular frame O-ring goalpost and can be use with or without the use of mobile applications service.

The camera device and 3D projector device mounted to the goalpost are design to provide content for the mobile devices and TV Screen. The purpose of the cameras is to capture the live video contents of goals being scored, following with the 3D Hologram projection of 3D floating images to announce the team's player's jersey, team logo, company sponsor, adverting, products and services.

The information is intended to be transmitted to mobile devices and TV Screen during the live sports event using Digital Broadcasting, technology Multimedia Messaging Service technology and live streaming technology and digital network technology so recipient can receive and view the same live scoring goal video streaming content and to see the 3D hologram floating imaging content that pop up in midair from any mobile device, and TV screen to reach millions of sport fan using their Mobile device such as smart phones, tablets, PC computers, TV screens, watches and wireless electronic mobile devices.

This technology is not limited to other sports having goalposts on any field of play, playing with any ball and objects in outdoor and indoor stadium, arenas, courts, racetrack, track and fields, ice fields, and water fields, not limited to winter sport, summer sport etc. When this new scoring app technology is used during live professional sport events and competitions the event is able to be broadcast by any TV network, such as (NFL) National Football League's matches and tournament, FIFA World Cups and FIFA Confederation Cups and UEFA championship leagues tournaments. Further, the present invention primarily designed to professional sport leagues and the Olympic Games but is not limited to other sport such as baseball, basketball, American football, tennis, ice and field hockey, handball, soccer, rugby, cricket, lacrosse, and polo, to name a few nonlimiting examples.

The Camera devices and the 3D hologram projectors are not limited to using the wireless communication network technology, Additionally, the Multimedia Display System and Annular frame O-ring Goalpost having the camera devices and the 3Dimension Hologram projector use for the purpose of animation and entertainment game, electronic table game, recreation activity game, E-sport games, throwing target game, including annular frame use multi sports for amateur and professional athletes to improve precision to the hand throw and goal kick a ball and use with other instruments or device use in sport such as batt, racket.

Use by Soccer players practicing goal kick target practice, hand throw for American football quarterbacks for target practice to improve precision. Baseball player practicing target practice throwing the fastball using baseball ball and player baseball bat hits the ball, basketball hoops target practice using a ball, tennis target practice, using tennis racket and ball, cricket target practice using cricket bat, lacrosse target practice using cork, ice hockey target practice using the hockey stick. The annular frame can be used in a fixed position and while in motion for a more challenging target practice experience.

Additionally, the invention's annular frame structure is designed to be used manually or electronically for other purpose such as animation activity game and playground recreation game, table sports games, leisure and entertainment games using any ball, objects, instrument and electronic device by performing hand throw and goal kick directly or indirectly to the O-Ring goalposts. The athlete can use the hands and feet to perform target practice. The invention is also designed for digital games using the annular frame functionality and design. Target practice, new tool and equipment to incorporated for e-sports as a new generation of active video games and e-sports games. 2D and 3D animation games, and gaming, this innovative concept offers unlimited possibly.

What is claimed is:

1. An annular multimedia stadium goalpost and multipurpose target display system comprising:

a support assembly;

at least one primary annular frame;

at least one primary projector;

a net;

a first plurality of sensor-integrated fasteners;

the primary annular frame being mounted onto the support assembly;

the primary projector being mounted onto the primary annular frame;

the primary projector being optically coupled to a central portion of the primary annular frame;

the net being mounted onto the primary annular frame;

the net being positioned over the central portion of the primary annular frame;

the first plurality of sensor-integrated fasteners being radially distributed around the primary annular frame;

the first plurality of sensor-integrated fasteners being connected in between the primary annular frame and the net; and the net being positioned over the central portion of the primary annular frame.

2. The annular multimedia stadium goalpost and multipurpose target display system as claimed in claim 1 comprising:

at least one primary environmental sensor; and the primary environmental sensor being integrated into the primary annular frame.

3. The annular multimedia stadium goalpost and multipurpose target display system as claimed in claim 2 comprising:

the at least one primary environmental sensor comprising a plurality of motion sensors;

the plurality of motion sensors being distributed around the primary annular frame; and the plurality of motion sensors being oriented toward the central portion of the primary annular frame.

4. The annular multimedia stadium goalpost and multipurpose target display system as claimed in claim 2 comprising:

the at least one primary environmental sensor comprising a plurality of proximity sensors;

the plurality of proximity sensors being distributed around the primary annular frame; and the plurality of proximity sensors being oriented toward the central portion of the primary annular frame.

5. The annular multimedia stadium goalpost and multipurpose target display system as claimed in claim 1 comprising:

a primary annular display;

the primary annular display being integrated into the primary annular frame; and the primary annular display being concentrically aligned to the primary annular frame.

6. The annular multimedia stadium goalpost and multipurpose target display system as claimed in claim 1 comprising:

at least one secondary annular frame;

an intermediary support frame;

the intermediary support frame being connected in between the secondary annular frame and the primary annular frame; and the secondary annular frame being concentrically aligned to the primary annular frame.

7. The annular multimedia stadium goalpost and multipurpose target display system as claimed in claim 6 comprising:

at least one secondary environmental sensor; and the secondary environmental sensor being integrated into the secondary annular frame.

8. The annular multimedia stadium goalpost and multipurpose target display system as claimed in claim 7 comprising:

the at least one secondary environmental sensor comprising a plurality of motion sensors;

the plurality of motion sensors being distributed around the secondary annular frame; and the plurality of motion sensors being oriented toward the central portion of the primary annular frame.

9. The annular multimedia stadium goalpost and multipurpose target display system as claimed in claim 8 comprising:

the at least one secondary environmental sensor comprising a plurality of proximity sensors;

the plurality of proximity sensors being distributed around the secondary annular goal assembly; and the plurality of proximity sensors being oriented toward the central portion of the primary annular frame.

10. The annular multimedia stadium goalpost and multipurpose target display system as claimed in claim 7 comprising:

at least one frame camera;

at least one range finder video camera;

at least one frame projector; and the at least one frame camera, the at least one range finder video camera, and the at least one frame projector being mounted onto the intermediary support frame.

11. The annular multimedia stadium goalpost and multipurpose target display system as claimed in claim 7 comprising:

a second plurality of sensor-integrated fasteners;

the second plurality of sensor-integrated fasteners being radially distributed around the secondary annular frame; and the second plurality of sensor-integrated fasteners being connected in between the secondary annular frame and a rear portion of the net.

12. The annular multimedia stadium goalpost and multipurpose target display system as claimed in claim 11, wherein a rear portion of the net is flat.

13. The annular multimedia stadium goalpost and multipurpose target display system as claimed in claim 7 comprising:

a secondary annular display;

the secondary annular display being integrated into the secondary annular frame; and the secondary annular display being concentrically aligned to the secondary annular frame.

14. The annular multimedia stadium goalpost and multipurpose target display system as claimed in claim 7 comprising:

at least one secondary projector;

at least one three-dimensional LED fan projector;

the intermediary support frame being connected in between the primary annular frame and the support assembly;

the at least one secondary projector being mounted onto the connection between the intermediary support frame and the support assembly;

the three-dimensional LED fan projector being mounted onto the connection between the intermediary support frame and the support assembly; and the three-dimensional LED fan projector being linearly offset from the secondary projector.

15. The annular multimedia stadium goalpost and multipurpose target display system as claimed in claim 1 wherein the net is a flat, round, and transparent display device.

16. The annular multimedia stadium goalpost and multipurpose target display system as claimed in claim 1 comprising:

the support assembly comprising at least one support post and at least one adjustable support arm;

the adjustable support arm being terminally connected to the support post; and the primary annular frame being mounted onto the adjustable support arm, opposite to the support post.

17. The annular multimedia stadium goalpost and multipurpose target display system as claimed in claim 16 comprising:

a solar platform base; and the solar platform base being terminally mounted onto the support post, opposite to the adjustable support arm.

18. The annular multimedia stadium goalpost and multipurpose target display system as claimed in claim 16 comprising:

an airbag padding system;

a foldable display;

at least one support speaker;

at least one support camera;

at least one support projector;

the airbag padding system being laterally mounted around the support post;

the foldable display being laterally mounted onto the support post;

the foldable display being positioned laterally offset from the airbag padding system;

the support speaker being laterally mounted onto the support post;

the support speaker being positioned in between the airbag padding system and the adjustable support arm;

the support camera being laterally mounted onto the support speaker;

the support projector being laterally mounted onto the support speaker; and the support projector being positioned offset from the support camera, across the support speaker.

19. The annular multimedia stadium goalpost and multipurpose target display system as claimed in claim 18 comprising:

at least one soft LED display; and the soft LED Display being superimposed onto the airbag padding system.

20. The annular multimedia stadium goalpost and multipurpose target display system as claimed in claim 1 comprising:

at least one multimedia bar system;

the multimedia bar system comprising a support bar, a plurality of lights, and a plurality of first speakers;

the multimedia bar system being mounted onto the support assembly;

the multimedia bar system being positioned offset from the primary annular frame, across the support assembly;

the support bar being mounted onto the support assembly, offset from the primary annular frame;

the plurality of lights being distributed along the support bar;

each of the plurality of lights being adjacently connected to the support bar;

the plurality of first speakers being distributed along the support bar;

each of the plurality of first speakers being adjacently connected to the support bar; and each of the plurality of first speakers and each of the plurality of lights being oriented toward the primary annular frame.

21. The annular multimedia stadium goalpost and multipurpose target display system as claimed in claim 20 comprising:

the multimedia bar system further comprising a plurality of sponsor display panels;

the plurality of sponsor display panels being distributed along the support bar; and each of the plurality of sponsor display panels being adjacently connected to the support bar.

22. The annular multimedia stadium goalpost and multipurpose target display system as claimed in claim 20 comprising:

the multimedia bar system further comprising at least one pivoting projector device and at least one end projector;

the pivoting projector device being centrally and externally mounted to the support bar; and the end projector being pivotably and terminally mounted onto the support bar.

23. The annular multimedia stadium goalpost and multipurpose target display system as claimed in claim 20 comprising:

the multimedia bar system further comprising a camera track, at least one rangefinder laser-detector video camera, and at least one panoramic camera;

the camera track being positioned parallel and offset to the support bar;

the camera track being mounted along the support bar;

the first rangefinder laser-detector video camera and the panoramic camera being slidably mounted onto and along the camera track; and the first rangefinder laser-detector video camera and the panoramic camera being oriented toward the primary annular frame.

24. The annular multimedia stadium goalpost and multipurpose target display system as claimed in claim 20 comprising:

at least one retractable screen assembly;

the retractable screen assembly comprising a motorized housing and a screen;

the retractable screen assembly being integrated into the multimedia bar system; and the screen being operatively coupled to the motorized housing, wherein the motorized housing is used to externally deploy or internally withdrawn the screen from the motorized housing.

25. The annular multimedia stadium goalpost and multipurpose target display system as claimed in claim 24 comprising:

at least one external projector device;

the external projector device being mounted offset to the primary annular frame; and the external projector device being oriented toward the screen.

26. The annular multimedia stadium goalpost and multipurpose target display system as claimed in claim 1 comprising:

at least one main computing device;

a multimedia bar system;

at least one wireless communications system; and the wireless communications system, the primary projector, and the multimedia bar system being electronically connected to the main computing device.

27. The annular multimedia stadium goalpost and multipurpose target display system as claimed in claim 26 comprising:

at least one human interface device (HID);

the HID being electronically connected to the main computing device; and the HID being externally mounted onto the support assembly.

28. The annular multimedia stadium goalpost and multipurpose target display system as claimed in claim 26 comprising:

at least one remote server;

at least one personal computing (PC) device; and the main computing device being communicably coupled to the at least one remote server and the at least one PC device.

29. The annular multimedia stadium goalpost and multipurpose target display system as claimed in claim 26 comprising:

at least one position tracking unit;

at least one ball;

the position tracking unit being integrated into the ball; and the position tracking unit being communicably coupled to the wireless communications system.

* * * * *